US007621622B2

(12) United States Patent
Kachi

(10) Patent No.: US 7,621,622 B2
(45) Date of Patent: Nov. 24, 2009

(54) LIQUID EJECTION HEAD

(75) Inventor: Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 354 days.

(21) Appl. No.: 11/376,155

(22) Filed: Mar. 16, 2006

(65) Prior Publication Data

US 2006/0209138 A1 Sep. 21, 2006

(30) Foreign Application Priority Data

Mar. 18, 2005 (JP) ..... 2005-080162

(51) Int. Cl.
*B41J 2/045* (2006.01)

(52) U.S. Cl. ..... 347/68; 347/50; 347/55

(58) Field of Classification Search ..... 347/50, 347/55, 56, 58, 68
See application file for complete search history.

(56) References Cited

U.S. PATENT DOCUMENTS

| | | | | |
|---|---|---|---|---|
| 6,616,270 | B1 | 9/2003 | Miyata et al. | |
| 6,945,636 | B2 * | 9/2005 | Sakaida et al. | 347/68 |
| 2003/0206218 | A1 | 11/2003 | Miyata et al. | |

FOREIGN PATENT DOCUMENTS

| | | | |
|---|---|---|---|
| JP | 9-327912 | A | 12/1997 |
| JP | 2003-136721 | A | 5/2003 |
| JP | 2003-251813 | A | 9/2003 |

* cited by examiner

*Primary Examiner*—Lam S Nguyen

(74) *Attorney, Agent, or Firm*—Birch, Stewart, Kolasch & Birch, LLP

(57) ABSTRACT

The liquid ejection head comprises: a plurality of pressure chambers which are provided correspondingly to a plurality of ejection holes formed on a first wall defining the pressure chambers, the ejection holes being two-dimensionally arranged and ejecting liquid toward a liquid receiving medium, the pressure chambers accommodating the liquid to be ejected from the ejection holes; a common liquid chamber which supplies the liquid to the pressure chambers; a plurality of piezoelectric elements which are provided correspondingly to the pressure chambers and are arranged on a second wall defining the pressure chambers opposing the first wall, the piezoelectric elements each having individual electrodes to which drive signals are applied; a plurality of extending electrodes which extend from the individual electrodes of the piezoelectric elements and are electrically connected to the individual electrodes; a structural member which is bonded to a first surface of the second wall reverse to a second surface thereof adjacent to the pressure chambers, the structural member having a laminated structure in which at least two members are arranged to overlap each other, the at least two members including an outermost member having a surface in contact with atmosphere and serving as a heat radiating member, the at least two members including at least one member serving as a heat insulating member; a drive circuit which is installed on the outermost member of the structural member, the drive circuit generating the drive signals to be applied to the piezoelectric elements; and a plurality of conducting members which electrically connect the extending electrodes and the drive circuit, the conducting members having vertical conducting portions which are formed in a direction substantially vertical to a plane on which the piezoelectric elements are arranged, and horizontal conducting portions which are formed in a direction substantially perpendicular to the vertical conducting portions, the vertical conducting portions being contained in the structural member.

17 Claims, 13 Drawing Sheets

LIQUID EJECTION HEAD

BACKGROUND OF THE INVENTION

1. Field of the Invention

The present invention relates to a liquid ejection head, and more particularly, to technology for achieving high density arrangement of wiring, drive circuits, and the like, of drive elements which apply an ejection force to liquid to be ejected from ejection holes.

2. Description of the Related Art

In recent years, inkjet recording apparatuses have come to be used widely as data output apparatuses for outputting images, documents, or the like. An inkjet recording apparatus forms an image, document, or the like, corresponding to data, on a medium by ejecting ink from nozzles, by driving actuators corresponding to nozzles provided in a print head, in accordance with data.

There have been increasingly demands for improved quality in the image produced by inkjet recording apparatuses. By creating an image by means of dots of very small size arranged at high resolution, improved quality in the final image can be achieved. In order to achieve a very small dot size, it is necessary to make the nozzle diameter very small, thereby achieving a very small volume in the ink droplets ejected from the nozzles in each ejection operation. Furthermore, in order to achieve a high-resolution arrangement of dots, the nozzle density should be increased and droplet ejection control suited to the increased resolution of the dot arrangement should be implemented.

Furthermore, in a composition where an ink ejection force is obtained by means of actuators, such as piezoelectric elements, then if the density of the nozzle arrangement is increased, the actuators are also disposed at high density in accordance with nozzle arrangement. When actuators are disposed at high density, it is difficult to arrange the wires which transmit drive signals to the actuators on the surface on which the actuators are installed, and a high-density arrangement of the actuators and the wires to the actuators is achieved by firstly extending the wires in a perpendicular direction from the surface where the actuators are installed, and then arranging the wires in a horizontal direction, by using a wiring member such as a flexible printed circuit formed with multiple layers.

Japanese Patent Application Publication No. 2003-136721 discloses an actuator apparatus, an inkjet type recording head and an inkjet type recording apparatus, in which a junction member is bonded to a flow channel forming substrate in which nozzles, pressure chambers, and the like, are formed. The junction member is placed on the side of the flow channel forming substrate on which the piezoelectric elements are arranged. An installation section to which external wires are connected is arranged in a region on the junction member reverse to the side of the piezoelectric elements, and drive wires are arranged on the junction member, one end of each wire being connected to the installation section and the other end of each wire being connected to each piezoelectric element. The structure of the inkjet recording head is thereby simplified and reduced in size.

Japanese Patent Application Publication No. 2003-251813 discloses an inkjet head, an inkjet recording apparatus and a laminated piezoelectric element, in which external electrodes extend onto a step section of piezoelectric elements having an L-shaped cross-section and are arranged into through holes in a laminated ceramic substrate by wire bonding. A driver IC (integrated circuit) to which the external electrodes are electrically connected is installed on the surface of the laminated ceramic substrate reverse to the surface thereof where the piezoelectric elements are arranged. Therefore, the operability and reliability of the wiring to the piezoelectric elements is improved, and an inkjet head having a simple and compact structure is obtained.

Japanese Patent Application Publication No. 9-327912 discloses a recording head, in which an inkjet recording head is composed by a junction-free, single-plate silicon monocrystalline substrate, in which nozzles, pressure chambers, a diaphragm, a common ink chamber, and the like, are formed, and a head frame section, and therefore the head has few constituent parts and the head structure is simple.

However, if a wiring member, such as a flexible printed circuit, is used to extend wires from the actuators in a horizontal direction, then the current capacity and size of the wiring member place limitations on the extent to which wiring density can be increased. For example, if a flexible printed circuit is used as a wiring member, then although it is possible to increase the wiring density by building the flexible printed circuit with multiple layers, considerations such as the difficulty of manufacture and the strength place limits on the multi-layer structure that can be achieved in the flexible printed circuit.

Furthermore, in order to reduce the size of the head, it is possible to install a drive circuit for driving the actuators, on a flexible printed circuit as described above, or on a structural member of the head, but the heat generated by this drive circuit may cause increased temperature variation in the ink. If there is increased temperature variation in the ink, then this can lead to unstable ejection, and a significant decline in ejection performance.

In the actuator apparatus, inkjet recording head and inkjet recording apparatus disclosed in Japanese Patent Application Publication No. 2003-136721, it is necessary to position the members with high precision when bonding the junction member with the flow channel forming substrate, and therefore, the manufacturing process is difficult. Furthermore, due to the heat radiation design of the installation section connected to the junction member, the heat generated by the drive circuit (driver IC) mounted on the installation section is transmitted to the flow channel forming substrate, and there is a probability that this may cause a change in the temperature of the ink inside the pressure generating chambers.

Moreover, in the inkjet head, inkjet recording apparatus and laminated piezoelectric elements disclosed in Japanese Patent Application Publication No. 2003-251813, since the piezoelectric elements are formed with the L-shaped cross-section, the manufacture of the piezoelectric elements is complicated, and the difficulty of manufacturing the piezoelectric elements is increased. Furthermore, the presence of the step sections onto which the external electrodes of the piezoelectric elements extend obstructs a high-density arrangement of the piezoelectric elements.

Furthermore, Japanese Patent Application Publication No. 9-237912 only discloses technology for achieving a simple structure having a small number of constituent parts, but it does not discuss how to achieve. a high density arrangement in the recording head.

SUMMARY OF THE INVENTION

The present invention has been contrived in view of the foregoing circumstances, an object thereof being to provide a liquid ejection head which achieves a high-density arrangement of drive elements and wires to these drive elements, in accordance with ejection holes and pressure chambers arranged at high density, while also achieving stable ejection.

In order to attain the aforementioned object, the present invention is directed to a liquid ejection head, comprising: a plurality of pressure chambers which are provided correspondingly to a plurality of ejection holes formed on a first wall defining the pressure chambers, the ejection holes being two-dimensionally arranged and ejecting liquid toward a liquid receiving medium, the pressure chambers accommodating the liquid to be ejected from the ejection holes; a common liquid chamber which supplies the liquid to the pressure chambers; a plurality of piezoelectric elements which are provided correspondingly to the pressure chambers and are arranged on a second wall defining the pressure chambers opposing the first wall, the piezoelectric elements each having individual electrodes to which drive signals are applied; a plurality of extending electrodes which extend from the individual electrodes of the piezoelectric elements and are electrically connected to the individual electrodes; a structural member which is bonded to a first surface of the second wall reverse to a second surface thereof adjacent to the pressure chambers, the structural member having a laminated structure in which at least two members are arranged to overlap each other, the at least two members including an outermost member having a surface in contact with atmosphere and serving as a heat radiating member, the at least two members including at least one member serving as a heat insulating member; a drive circuit which is installed on the outermost member of the structural member, the drive circuit generating the drive signals to be applied to the piezoelectric elements; and a plurality of conducting members which electrically connect the extending electrodes and the drive circuit, the conducting members having vertical conducting portions which are formed in a direction substantially vertical to a plane on which the piezoelectric elements are arranged, and horizontal conducting portions which are formed in a direction substantially perpendicular to the vertical conducting portions, the vertical conducting portions being contained in the structural member.

According to the present invention, in the inkjet head having the ejection holes and the pressure chambers arranged two-dimensionally, the wiring members which transmit the drive signals to the piezoelectric elements provided to correspond with the pressure chambers contain at least vertical conducting members, of the vertical conducting members formed so as to pass through the structural member (upper structural body) comprising the heat insulating member and the heat radiating member, and horizontal conducting members formed in the direction substantially perpendicular to the vertical conducting members. Therefore, it is possible readily to achieve high-density arrangement of the electrical wires between the piezoelectric element drive circuit and the piezoelectric elements.

Furthermore, since the structural member is constituted by the heat radiating member provided on the outermost layer, and one or more layers of the heat insulating member, in such a manner that the drive circuit for driving the piezoelectric elements is installed on the heat radiating member, then the heat generated by the drive circuit is radiated efficiently to the exterior, and furthermore, the effects of heat generated by the drive circuit onto the interior of the liquid ejection head (the liquid to be ejected from the liquid ejection head) can be reduced.

The conducting members may each comprise one vertical conducting member (the piezoelectric elements and the drive circuit may be connected together by means of one vertical conducting member), or the conducting members may comprise a vertical conducting member and a horizontal member. Furthermore, the conducting members may also comprise a plurality of vertical conducting members and a plurality of horizontal conducting members.

The vertical conducting members may be formed so as to pass through the whole of the structural member, or the vertical conducting members may be formed so as to pass through at least one member of the heat insulating member and the heat radiating member, and be bonded to another vertical conducting member or to the drive circuit, by means of the horizontal conducting member. By providing an insulation covering (insulation treatment) on the conducting members, it is also possible to use a metal material for the heat radiating member.

The piezoelectric elements which apply an ejection pressure to the liquid to be ejected from the ejection holes may comprise a common piezoelectric body (piezoelectric member) for a plurality of pressure chambers, with an individual electrode being provided on the piezoelectric body to correspond to each pressure chamber (divided electrode system), or alternatively, a piezoelectric body and an individual electrode may be provided for each individual pressure chamber (mechanically divided system). Furthermore, the piezoelectric elements may have a laminated structure in which a plurality of piezoelectric bodies and electrodes are arranged alternately.

The liquid ejection head may be a line head having an ejection hole row of a length corresponding to the possible width of the liquid receiving region on the liquid receiving medium which receives the liquid ejected from the ejection holes, or the liquid ejection head may be a shuttle head having an ejection hole row of a length which does not reach the possible width of the liquid receiving region, the head being able to eject liquid over the full width of the liquid receiving region on the liquid receiving medium by means of relative movement between the liquid receiving medium and the liquid ejection head in the width direction of the liquid receiving medium.

Moreover, "liquid receiving medium" indicates a medium (media) which receives a liquid ejected by a liquid ejection head, and this term includes various types of media, irrespective of material and size, such as continuous paper, cut paper, sealed paper, resin sheets such as OHP sheets, film, cloth, and other materials.

Preferably, the at least two members of the structural member include an insulating structural member bonded to the first surface of the second wall.

By providing the insulating structural member which supports the heat insulating member and the heat radiating member, on the surface of the structural member to which the pressure chambers are arranged, it is possible to support the heat insulating member, the heat radiating member, and the drive circuit installed on the heat radiating member, in a reliable fashion, and therefore, a prescribed level of rigidity can be ensured in the head. Furthermore, it becomes unnecessary to provide an insulation treatment on the heat insulating member and/or the heat radiating member.

Preferably, the drive circuit is integrated in at least one integrated circuit, the at least one integrated circuit being flip-chip mounted on the heat radiating member.

Since the drive circuit which generates the drive signals for the piezoelectric elements is integrated into one or two or more integrated circuits, which are flip-chip mounted on the drive circuit installation surface of the heat radiating member, then it is possible to install the drive circuit at a high density, thereby making it possible to reduce the region (surface area) of the drive circuit installation surface which is occupied by the drive circuit. Furthermore, since the drive circuit can be installed in a distributed fashion, it is possible to reduce the installation density of the vertical conducting members and the horizontal conducting members in the vicinity of the drive circuit.

The drive circuit installation surface may be on the side of the heat radiating member opposite to the heat insulating member (the upper surface of the heat radiating member), or it may be the side adjacent to the heat insulating member (the lower surface of the heat radiating member).

Preferably, thermal conductivity of the heat radiating member is higher than thermal conductivity of the heat insulating member.

Preferably, from the viewpoint of radiating the heat of the drive circuit, the heat radiating member has the thermal conductivity exceeding 15 (W/m·K), and members satisfying these conditions are, for example, members made of ceramic (e.g., alumina) or metal. Furthermore, from the viewpoint of controlling the temperature inside the common liquid chamber, preferably, the heat insulating member has the thermal conductivity less than 1 (W/m·K), and materials satisfying these conditions are epoxy resin and glass, for instance.

Preferably, the heat insulating member includes one of thermosetting epoxy resin and thermosetting epoxy resin containing micro-particles of inorganic material.

Thermosetting epoxy resin, or thermosetting epoxy resin containing micro-particles of inorganic material, has high thermal resistance and is suitable for flip-chip mounting of the drive circuit. Furthermore, this material also has high electrical insulation properties and low water absorption, and therefore it is suitable for use in the structural body which constitutes the liquid ejection head.

Preferably, the drive circuit is provided with a drive circuit heat radiating member.

By arranging the drive circuit heat radiating member on the drive circuit, it is possible to radiate the heat generated by the drive circuit, efficiently, to the exterior.

A metallic member having high thermal conductivity, such as copper, aluminum, or the like, can be used for the drive circuit heat radiating member.

Preferably, thermal conductivity of the drive circuit heat radiating member is higher than thermal conductivity of the heat insulating member.

The thermal conductivity of the drive circuit heat radiating member may be substantially the same as the thermal conductivity of the heat radiating member on which the drive circuit is installed. Furthermore, the thermal conductivity of the drive circuit heat radiating member may be greater than, equal to, or lower than the thermal conductivity of the heat radiating member.

Preferably, the common liquid chamber is arranged on a side of the first surface of the second wall; and the conducting members are arranged so as to rise from the surface of the second wall on which the piezoelectric elements are arranged and pass through the common liquid chamber.

If the common liquid chamber is arranged on the side of the pressure chambers adjacent to the liquid ejection direction, then the size of the common liquid chamber is reduced in cases where the ejection holes and the pressure chambers are arranged at high density, and there is a probability that the liquid supply to the pressure chambers is not keep up with demand, when ejecting liquid at a high ejection frequency. Furthermore, if the common liquid chamber is increased in size, then the length of the ejection side flow path from the pressure chambers to the ejection holes is increased, and there is a probability that a high ejection frequency is not sustainable. Consequently, the plane-shaped common liquid chamber having a prescribed surface area is provided on the opposite side of the pressure chambers with respect to the liquid ejection direction, and the liquid is supplied from this common liquid chamber to the pressure chambers in a vertical direction. Therefore, the liquid can be supplied without delay, while maintaining a high ejection frequency.

Furthermore, since a structure is adopted in which the conducting members for transmitting the drive signals to the piezoelectric elements are provided so as to rise from the piezoelectric element installation surface and pass through the common liquid chamber, it is possible to arrange the piezoelectric elements (individual electrodes), pressure chambers, and ejection holes, at a high density.

These conducting members are covered by an insulating structural member, in such a manner that they do not make contact with the liquid accommodated inside the common liquid chamber (in such a manner that prescribed insulating characteristics are ensured).

Preferably, the drive circuit is arranged in a region on the heat radiating member corresponding to a region where the pressure chambers and/or the common liquid chamber are not arranged.

Since the drive circuit is arranged so as to avoid the region (liquid flow channel region) where the pressure chambers and/or the common liquid chamber (liquid flow channel) is situated, then it is possible to reduce temperature variation of the liquid inside the liquid flow channel due to the heat generated by the drive circuit. Since the temperature variation inside the liquid flow channel is reduced, it is possible to suppress increase in the density or viscosity of the liquid.

Preferably, the ejection holes are arranged through a length corresponding to a full width of a liquid receiving region of the liquid receiving medium.

In a line head which corresponds to the full width of the liquid receiving region on the liquid receiving medium, it is possible to eject liquid toward the full width of the possible liquid receiving region of the liquid receiving medium, by moving at least one of the liquid ejection head and the liquid receiving medium, once only, in a direction substantially perpendicular to the width direction of the liquid receiving medium. Therefore, compared to a method where a head of shorter width than the width of the liquid receiving region on the liquid receiving medium is moved in the width direction of the liquid receiving medium to scan the liquid receiving medium, it is possible to eject liquid onto the whole area of the possible liquid receiving region of the liquid receiving medium, in a shorter time.

The liquid ejection head may comprise a plurality of liquid ejection head modules which are arranged in a width direction of the liquid receiving medium, each of the liquid ejection head modules having an ejection hole row in which the ejection holes are arranged through a length shorter than the full width of the liquid receiving region of the liquid receiving medium.

A long head corresponding to a liquid receiving medium of a large size (for example, poster size) is more difficult to manufacture, since ejection characteristics change with variations during manufacture (during assembly), but a long head corresponding to a liquid receiving medium of large size can be manufactured readily by combining together a plurality of short heads which are easier to manufacture than a long head.

By combining the head modules together in a staggered matrix fashion, it is possible to achieve a length that corresponds to the full width of the liquid receiving medium.

According to the present invention, conducting members which transmit drive signals to two-dimensionally arranged piezoelectric elements are disposed so as to pass vertically from extending electrodes of the piezoelectric elements, through a structural member having a heat radiating member provided in the outermost layer thereof and having one or more layer of heat insulating member, and are bonded electrically to a drive circuit installed on a surface of the structural member which is substantially perpendicular to the vertical wiring members. Therefore, it is possible readily to achieve a high-density arrangement of electrical wires.

Furthermore, since the drive circuit which drives the piezoelectric elements is installed on the heat radiating member, the heat generated. by the drive circuit is radiated efficiently to the exterior, and furthermore, by providing the heat insulating member, it is possible to reduce the effects of the heat generated by the drive circuit onto the interior of the liquid ejection head.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
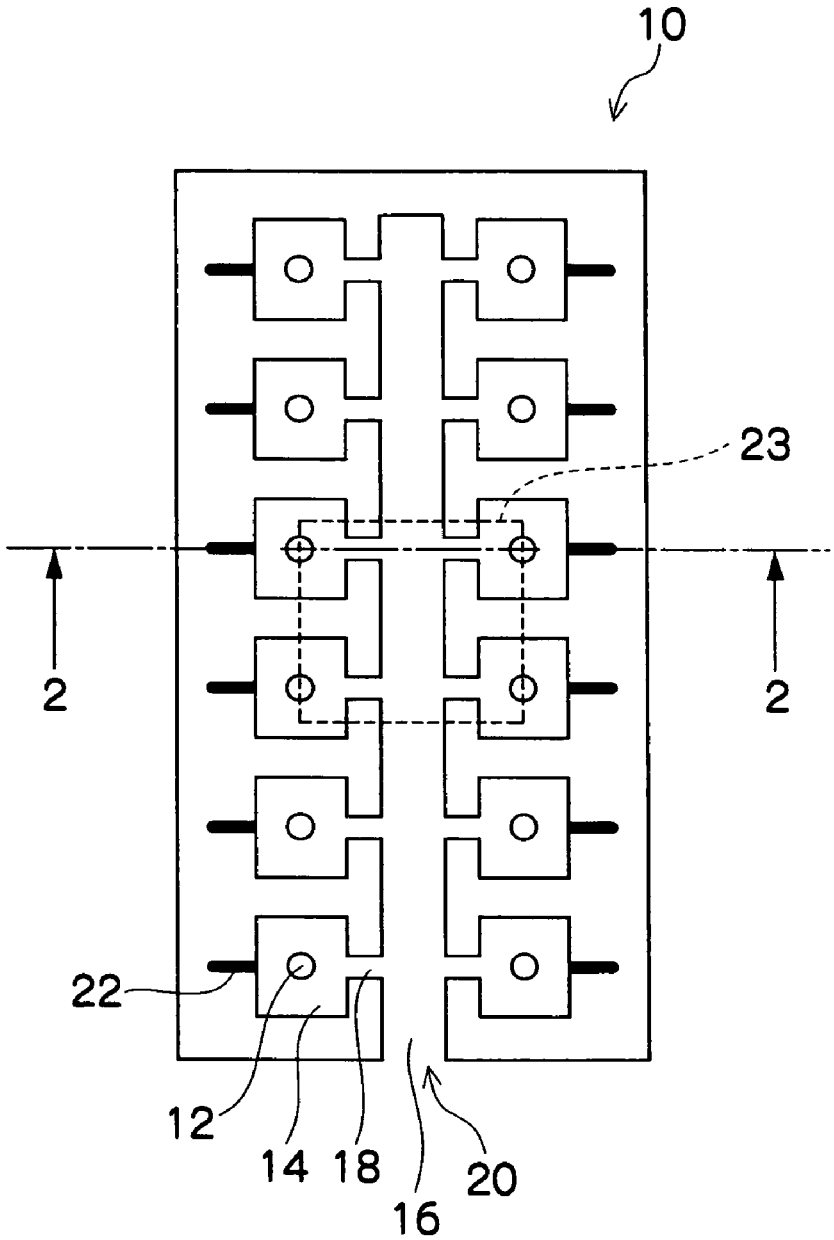
FIG. 1 is a plan view perspective diagram showing the structure of the liquid ejection head according to a first embodiment of the present invention.
Figure 2:
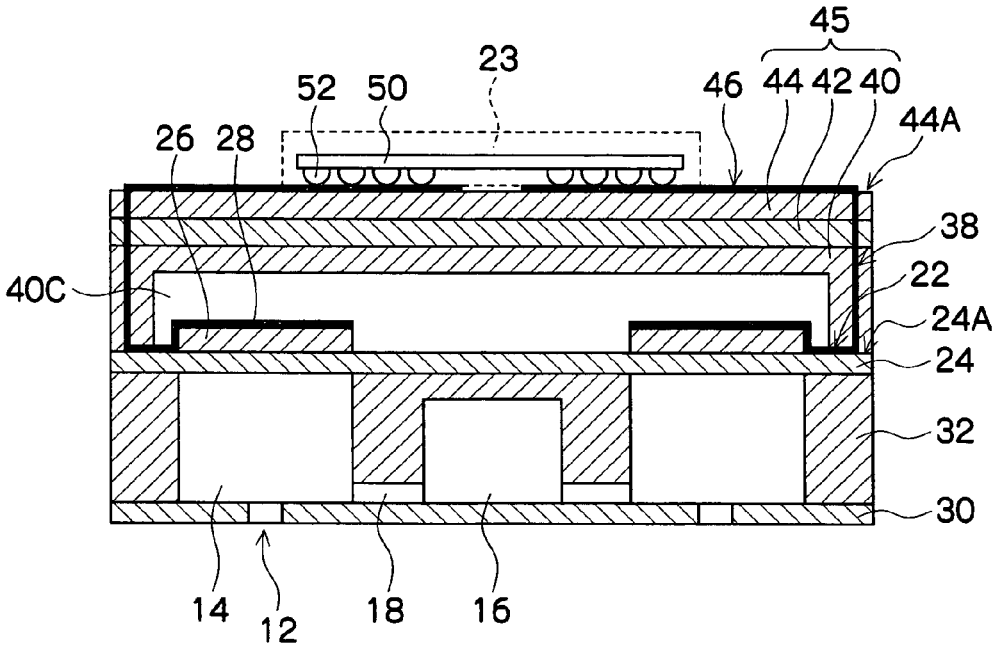
FIG. 2 is a cross-sectional diagram along line 2-2 in FIG. 1.

FIG. 1 is a plan view perspective diagram showing the structure of a liquid ejection head (ejection device, hereinafter, simply called a "head") 10 according to a first embodiment of the present invention, and FIG. 2 is a cross-sectional diagrams showing the three-dimensional structure of the head 10 (a cross-sectional diagram along line 2-2 in FIG. 1).

The head 10 shown in FIG. 1 is an inkjet head mounted in an inkjet recording apparatus which forms a prescribed image on a medium (liquid receiving medium) by means of ink ejected from ejection holes, for example. The head 10 may also be known as a print head, recording head, or the like.

As shown in FIG. 1, the head 10 comprises: nozzles (ejection holes) 12 which eject ink (liquid); pressure chambers 14 having a substantially square planar shape, which accommodate the ink to be ejected from the nozzles 12; supply ports 18 through which the ink is supplied to the pressure chambers 14 from the ink supply system (not shown) through the common liquid chamber (common flow channel) 16; a refill port 20 through which the ink is refilled into the common liquid chamber 16 from the ink supply system; and pads (extending electrodes) 22 extending to the exterior of the piezoelectric elements 26 (not shown in FIG. 1, but shown in FIG. 2) which apply an ejection force to the ink accommodated inside the pressure chambers 14, from the individual electrodes 28 (shown in FIG. 2) provided on these piezoelectric elements.

FIG. 1 shows a mode where the pads 22 are arranged to the outside of the piezoelectric elements 26, but the pads 22 may also be formed on the surface of the piezoelectric elements 26 where the individual electrodes 28 are formed. Furthermore, if the pads 22 are arranged on a pressurization plate 24 (shown in FIG. 2), which also serves as a common electrode, then an insulating layer (not shown) is formed between the pressurization plate 24 and the pads 22.

The substantially square shape defined with the dashed line denoted with a reference numeral 23 in FIG. 1 is a driving circuit or a switching IC (integrated circuit) (also referred to as SWIC) which generates drive signals for driving the piezoelectric elements 26.

The head 10 shown in FIG. 1 has six nozzle groups in the column direction, each group comprising two nozzles 12 arranged in the row direction. The nozzle arrangement shown in FIG. 1 merely represents an example, and one nozzle group may have two or more nozzles (or only one nozzle) 12. Furthermore, the number of nozzle groups in the column direction may also be less than six or more than six.

As shown in FIG. 2, the pressurization plate 24 forms the ceiling of the pressure chambers 14, and the piezoelectric elements (piezoelectric actuators) 26 for applying an ejection force to the ink accommodated inside the pressure chambers 14 are arranged on the surface of the pressurization plate 24 reverse to the surface adjacent to the pressure chambers 14. The piezoelectric elements 26 have individual electrodes 28 which apply a drive signal, arranged on the upper part of same (reverse to the surface adjacent to the pressurization plate 24), and a common electrode provided on the surface of the. piezoelectric element 26 reverse to the individual electrode 28 is formed by the pressurization plate 24, which is made of a material having conductive properties, for example, a metal material such as stainless steel.

If the pressurization plate 24 is made of a material having insulating properties, (an insulating material or non-conducting material), such as resin or ceramic, then the common electrode made of a conducting member, such as metal, is provided on the surface of the piezoelectric elements 26 opposite to the individual electrodes 28.

FIG. 2 shows a mode where the piezoelectric elements 26 are arranged on the opposite side of the pressurization plate 24 from the pressure chambers 14 (in other words, outside the pressure chambers 14), but if the piezoelectric elements 26 are subjected to a prescribed insulation treatment and ink resistance treatment, then it is also possible to arrange the piezoelectric elements 26 on the same side of the pressurization plate 24 as the pressure chambers 14 (in other words, inside the pressure chambers 14).

In a mode in which the piezoelectric elements 26 are arranged inside the pressure chambers 14, wires passing through the pressurization plate 24 are provided to electrically connect the individual electrodes 28 to the pads 22 arranged outside the pressure chambers 14.

As shown in FIG. 2, the head 10 has a laminated structure in which a plurality of cavity plates are arranged to overlap each other. More specifically, the head 10 comprises: a nozzle plate 30 in which the nozzles 12 are formed; a flow channel plate 32 formed with flow channels and liquid chambers for the pressure chambers 14, the common liquid chamber 16, and the like, arranged on the nozzle plate 30; and the pressurization plate 24 arranged on the flow channel plate 32.

Moreover, the pads 22 extending from the individual electrodes 28 to the exterior of the piezoelectric elements 26 are arranged on the piezoelectric element installation surface 24A of the pressurization plate 24, and vertical conducting members 38 formed in a vertical direction substantially perpendicular to the pads 22 are connected electrically with these pads 22.

The vertical conducting members 38 are formed so as to pass through an electrical wiring structure 45, which comprises an insulating structural member 40 formed on the piezoelectric element installation surface 24A of the pressurization plate 24 reverse to the pressure chambers 14, a heat insulating member 42 arranged on the reverse side of the insulating structural member 40 to the pressurization plate 24, and a heat radiating member 44 arranged on the reverse side of the heat insulating member 42 to the insulating structural member 40.

Horizontal conducting members 46 each having an end electrically connected to each vertical conducting member 38 are formed on the heat radiating member 44, and the other ends of the horizontal conducting members 46 are joined to a switching IC 23 installed on the surface (the drive circuit installation surface) 44A of the heat radiating member 44 reverse to the surface thereof adjacent to the heat insulating member 42.

More specifically, as described above, the switching IC 23 is connected electrically with the individual electrodes 28 arranged on the piezoelectric elements 26, by means of drive signal transmission paths comprising the horizontal conducting members 46, the vertical conducting members 38, and the pads 22, and signals generated in the switching IC 23 are transmitted to the individual electrodes 28 through the drive signal transmission paths.

The electronic components (electronic devices) constituting the switching IC 23 and the electrical wiring members (electrical wiring patterns) which electrically connect these elements shown in the present embodiment are formed inside a bare chip (chip core) 50 by means of a semiconductor manufacturing process, printing process, or the like, and the input and output terminals of this bare chip 50 are connected directly to the projecting electrodes (bumps) 52 formed on the horizontal conducting members 46. In other words, the switching IC 23 is flip-chip mounted on the heat radiating member 44. In the method shown in FIG. 2, the bare chip 50 is mounted face down, so that the front surface of the bare chip 50 faces the heat radiating member 44.

A conductive adhesive is used for bonding the projecting electrodes 52 with the bare chip 50. Furthermore, a conductive adhesive is also used to bond together the respective members which constitute the drive signal transmission paths. Of course, these members may be electrically connected by soldering.

When a flip-chip mount is used as shown in the present embodiment, it is possible to reduce the installation surface area of the switching IC 23, compared to an IC having a lead frame, and high-density arrangement or distributed arrangement of the drive circuit is facilitated. Furthermore, with a flip-chip mount, the wiring length is reduced in comparison with wire bonding, and it is possible to eliminate the induction components caused by the bonding wires. Consequently, electrical properties are improved (the delay time in transmission of the drive signals is reduced), and high-speed operation becomes possible.

In order to protect the junctions between the bare chip 50 and the projecting electrodes 52, the bare chip 50 and the installation region are sealed (molded) with an insulating member, such as epoxy resin, silicone, or the like.

Figure 3:
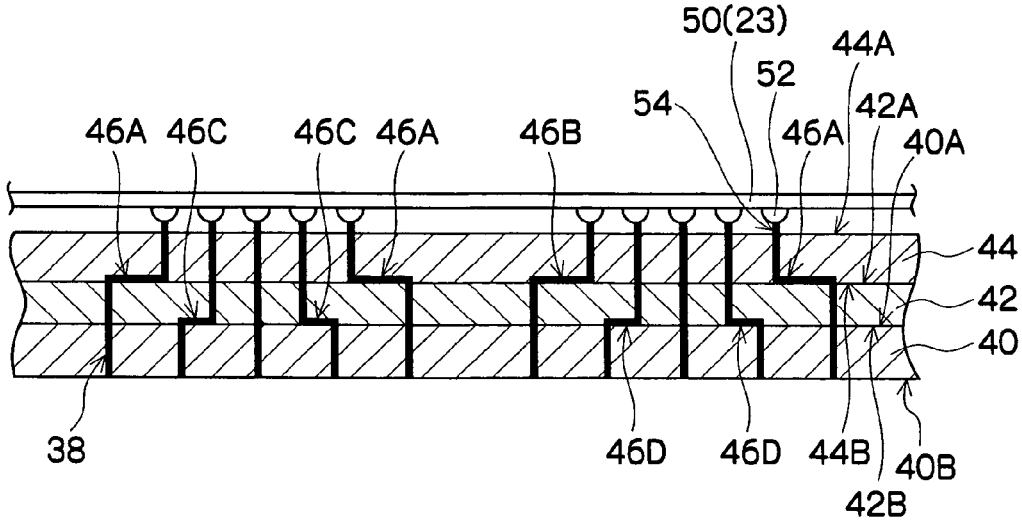
FIG. 3 is a diagram showing the detailed structure of the liquid ejection head shown in FIG. 2.

FIG. 2 shows a mode where the horizontal conducting members 46 are formed on the surface 44A of the heat radiating member 44 reverse to the surface adjacent to the heat insulating member 42, but as shown in FIG. 3, it is also possible that the horizontal conducting members 46 are formed on: the surface 44B of the heat radiating member 44 adjacent to the heat insulating member 42; the surface 42A of the heat insulating member 42 adjacent to the heat radiating member 44; the surface 42B of the heat insulating member 42 adjacent to the insulating structural member 40; the surface 40A of the insulating structural member 40 adjacent to the heat insulating member 42; and/or the surface 40B of the insulating structural member 40 adjacent to the pressurization plate 24.

In other words, the horizontal conducting members 46 may be formed on any of the surfaces of the insulating structural member 40, the heat insulating member 42 and the heat radiating member 44, which intersect with the vertical conducting members 38. Furthermore, the horizontal conducting members 46 are formed on at least one of these surfaces.

Reference numeral 46A shown in FIG. 3 indicates the horizontal conducting member 46 formed on the heat radiating member side 42A of the heat insulating member 42, and reference numeral 46B indicates the horizontal conducting member 46 formed on the heat insulating member side 44B of the heat radiating member 44. Furthermore, reference numerals 46C and 46D are the horizontal conducting members 46 formed respectively on the heat insulating member side 40A of the insulating structural member 40 and the insulating structural member side 42B of the heat insulating member 42.

In other words, the electrical wiring structure 45 having the laminated structure in which the insulating structural member 40, the heat insulating member 42, and the heat radiating member 44 are arranged successively in this order from the piezoelectric element installation surface 24A, is bonded onto the piezoelectric element installation surface 24A, and the conducting members for transmitting drive signals to be supplied to the piezoelectric elements 26 are formed so as to pass through this electrical wiring structure 45. These conducting members are constituted by the vertical conducting members 38 and the horizontal conducting members 46.

By adopting a multiple-layer composition for the electrical wiring structure 45 and distributing the horizontal conducting members 46 in the horizontal surfaces of the layers in this way, it is possible to reduce the wiring density of the horizontal conducting members 46 in each horizontal plane, as well as distributing the vertical conducting members 38 formed in each layer. Therefore, the step of patterning the vertical conducting members 38 and the horizontal conducting members 46 becomes easier to carry out. Moreover, it is preferable that the horizontal conducting members 46 are patterned onto the horizontal surfaces of the layers so as to coincide with the positions of the input and output terminals of the bare chip 50.

Projecting electrodes 54 which are electrically connected directly to the vertical conducting members 38 are formed on the surface 44A of the heat radiating member 44, and these projecting electrodes 54 are electrically connected to the input and output terminals of the bare chip 50.

The insulating structural member 40 is preferably made of an insulating material having prescribed insulating characteristics and prescribed strength, such as epoxy resin, or the like. Furthermore, a recess section 40C is formed in the insulating structural member 40 in the region where the piezoelectric elements 26 are disposed, in order to avoid obstructing the deformation of the pressurization plate 24 and the piezoelectric elements 26.

The heat insulating member 42A is arranged in order to prevent the heat generated by the switching IC 23 from being transmitted into the interior of the head 10 (and in particular, the ink flow channels including the pressure chambers 14, the common liquid chamber 16, and the like). The heat insulating member 42A is made of a material such as epoxy resin, glass, or the like, and is more preferably made of thermosetting epoxy resin, or thermosetting epoxy resin containing microparticles of inorganic material. The thickness of the heat insulating member 42 is designed on the basis of the ink replacement volume per unit time, and the amount of heat generated by the switching IC 23, in such a manner that the increase in the ink temperature from normal temperature remains within a prescribed range. It is preferable that the range of temperature increase of the ink is within 5° C. over normal temperature.

On the other hand, the heat radiating member 44 on which the switching IC 23 is mounted is made of a material having high thermal conductivity, such as ceramic (e.g., alumina) or metal, in order to ensure prescribed heat radiation performance, and the heat radiating member 44 is thus able to radiate the heat generated by the switching IC 23, efficiently, to the exterior of the head 10. If the heat radiating member 44 is made of a metallic material or a conductive material, a prescribed insulating coating (insulation treatment) is applied to portions of the heat radiating member 44 at which the vertical wiring members 38 and the horizontal wiring members 46 are formed, so as to insulate the vertical wiring members 38 and the horizontal wiring members 46 from the heat radiating member 44.

In this way, by adopting a multiple-layer composition for the electrical wiring structure 45 in which the vertical conducting members 38 and the horizontal conducting members 46 are formed, and by including the heat radiating layer (the heat radiating member 44) and the heat insulating layer (the heat insulating member 42) in this multiple-layer structure, it becomes possible to install the switching IC 23 on the region where the nozzles are arranged (region obtained by projecting the region on the nozzle plate 30 where the nozzles are arranged, to the surface 44A of the heat radiating member 44), and therefore, the head 10 can be reduced in size.

Furthermore, by installing the switching IC 23 on the heat radiating member 44 having high thermal conductivity, it is possible to obtain heat radiating effects for the switching IC 23, while at the same time, by composing at least one of the layers in the vicinity of the ink flow channels as the heat insulating member 42 having low thermal conductivity, it is possible to reduce the temperature variation in the ink inside the ink flow channels in response to the heat generated by the switching IC 23, and therefore, stable ejection characteristics can be maintained in the ejection device.

Here, the relationship between the thermal conductivity al of the heat radiating member 44 and the thermal conductivity $\beta$ of the heat insulating member 42 is $\alpha 1>\beta$, and the relationship between the thermal conductivity $\alpha 1$ of the heat radiating member 44 and the thermal conductivity $\gamma$ of the insulating structural member 40 is $\alpha 1>\gamma$.

The relationship between the thermal conductivity $\beta$ of the heat insulating member 42 and the thermal conductivity $\gamma$ of the insulating structural member 40 is $\beta \leqq \gamma$.

When using ceramic for the heat radiating member 44, the thermal conductivity $\alpha 1$ falls within the range of 15 (W/m·K) $\leqq \alpha 1 \leqq 30$ (W/m·K).

For example, when using alumina for the heat radiating member 44, the thermal conductivity $\alpha 1$ is 17 (W/m·K).

Consequently, it is suitable to use a material having the thermal conductivity of 15 (W/m·K) or above for the heat radiating member 44.

On the other hand, when using epoxy resin for the heat insulating member 42, the thermal conductivity $\beta$ is 0.19 (W/m·K).

When using glass for the heat insulating member 42, the thermal conductivity $\beta$ falls within the range of 0.55 (W/m·K) $\leqq \beta \leqq 0.75$ (W/m·K).

Consequently, it is suitable to use a material having the thermal conductivity of 1 (W/m·K) or below for the heat insulating member 42.

In the liquid ejection head 10 having the composition descried above, the vertical conducting members 38 are formed in a vertical direction (the opposite direction to the ink ejection direction), on the pads 22 extending onto the piezoelectric element installation surface 24A from the individual electrodes 28 of the piezoelectric elements 26 disposed inside the flow channel structure, which constitutes the flow channels for the pressure chambers 14, the common liquid chamber 16, and the like, and these vertical conducting members 38 pass through the insulating structural member 40 bonded to the opposite side of the flow channel structure with respect to the ink ejection direction, and also pass through the heat insulating member 42 and the heat radiating member 44 arranged on the insulating structural member 40, and are connected to the switching IC 23 by means of the horizontal conducting members 46 arranged on the surface 44A of the heat radiating member 44 reverse to the surface adjacent to the heat insulating member 42. Consequently, electrical connections to the switching IC 23 can be created readily from the piezoelectric elements 26 (the individual electrodes 28) provided corresponding to the pressure chambers 14 which are arranged at high density.

Furthermore, the switching IC 23 is installed on the heat radiating member 44 which radiates the heat generated by the switching IC 23 to the exterior of the head 10, and the heat insulating member 42 is provided between the switching IC 23 and the flow channel structural member, in such a manner that the heat generated by the switching IC 23 is radiated to the exterior without being transmitted into the head 10. Therefore, the temperature variation of the ink inside the head 10 is reduced, and desirable ink ejection can be achieved.

It is also possible to adopt a laminated structure comprising a plurality of layers (members) for the heat insulating member 42 (heat insulating layers), and a mode is also possible in which the heat insulating member 42 and the insulating structural member 40 are combined, provided that an insulating coating (insulation treatment) is applied on the vertical wiring members 38 and the horizontal wiring members 46.

Second Embodiment

Next, a liquid ejection head according to a second embodiment of the present invention is described. In the second embodiment, items which are the same as or similar to those in the first embodiment are denoted with the same reference numerals and description thereof is omitted here.

Figure 4:
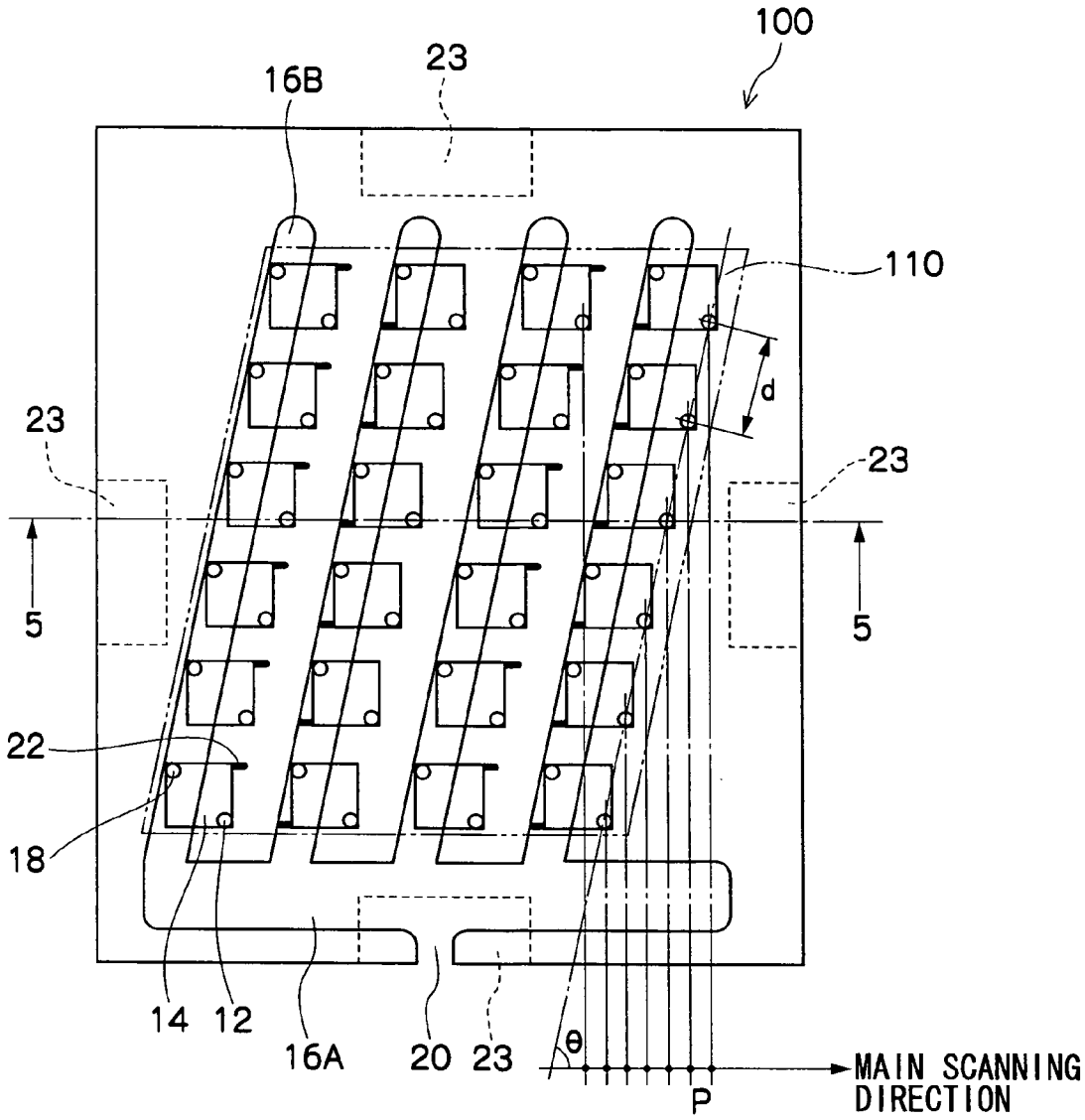
FIG. 4 is a plan view perspective diagram showing the structure of the liquid ejection head according to a second embodiment of the present invention.
Figure 5:
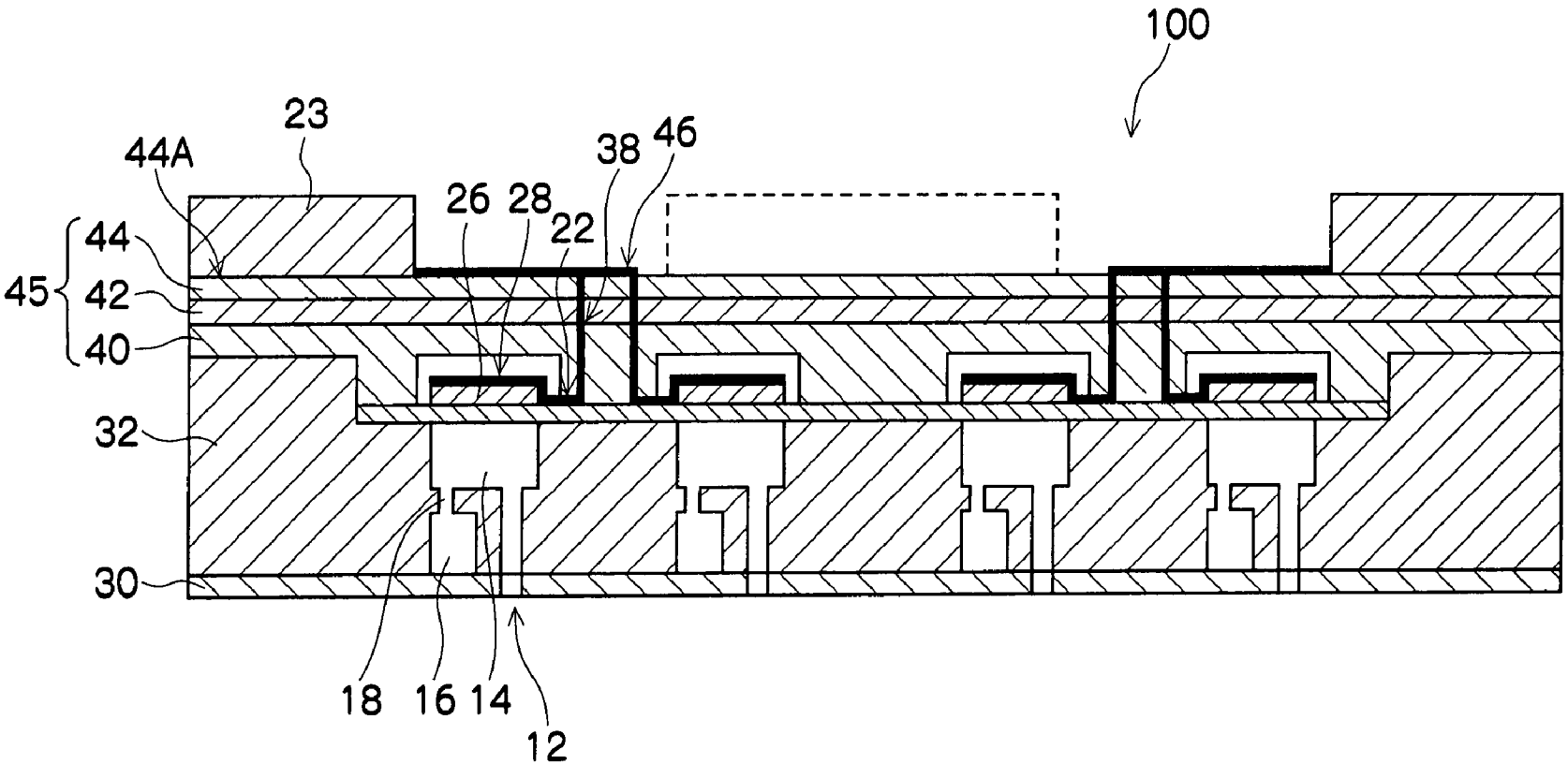
FIG. 5 is a cross-sectional diagram along line 5-5 in FIG. 4.

FIG. 4 is a plan view perspective diagram showing an embodiment of the structure of a head 100 having the nozzles 12 arranged in a matrix configuration, and FIG. 5 is a cross-sectional diagram showing the three-dimensional structure of the head 100 (a cross-sectional diagram along line 5-5 in FIG. 4).

In order to increase the resolution of the dots formed on the medium by the ink ejected from the head 100, (in other words, in order to achieve a reduced dot pitch), it is necessary to reduce the nozzle pitch in the nozzles 12 (or to achieve the high density of the nozzle arrangement) in the head 100. As shown in FIGS. 4 and 5, the head 100 according to the present embodiment has a structure in which the nozzles 12 and the pressure chambers 14 corresponding to the nozzles 12 are arranged in a staggered matrix configuration, thereby reducing the apparent nozzle pitch and achieving the high density of the nozzle arrangement.

The pressure chamber 14 provided corresponding to each of the nozzles 12 has a substantially square planar shape, and the nozzle 12 and an ink supply port 18 are arranged respectively at either comer on a diagonal of the pressure chamber 14. Each pressure chamber 14 is connected to the common liquid chamber 16 through the supply port 18.

The plurality of nozzles 12 and the pressure chambers 14, and the like, having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure wherein the plurality of nozzles 12, the pressure chambers 14, and the like, are arranged at a uniform pitch d in a direction having an angle $\theta$ with respect to the main scanning direction, the pitch P of the nozzles when projected to an alignment in the main scanning direction will be $d \times \cos\theta$.

FIG. 4 shows the head 100 having the nozzles 12 disposed in a matrix comprising four rows and six columns, but the head 100 may have a larger number of nozzles 12 than this.

More specifically, the arrangement can be treated equivalently to one in which the nozzles 12 are arranged in a linear fashion at a uniform pitch P, in the main scanning direction. By means of this composition, it is possible to achieve a nozzle composition of high density, in which the nozzle columns projected in the main scanning direction reach a total of 2400 per inch (2400 nozzles per inch).

In the head 100 having the nozzles 12 arranged in a matrix configuration of this kind, as shown in FIG. 1, if the switching ICs 23 are disposed in the nozzle and pressure chamber region 110 (indicated by the double-dotted lines) where the nozzles and the pressure chambers are disposed as projected to the surface 44A of the heat radiating member 44, then the electrical wiring pattern (the horizontal conducting members 46) on the surface 44A of the heat radiating member 44 has high density, and it is difficult to form an electrical connection pattern having a high density of this kind.

In order to resolve the aforementioned problem, it is possible to arrange the nozzles 12 in such a manner that they are not positioned directly below the region where the switching ICs 23 are installed (in other words, in the nozzle and pressure chamber region 110), but a nozzle arrangement of this kind has a possibility of increasing the pitch error between the nozzles 12.

Figure 6:
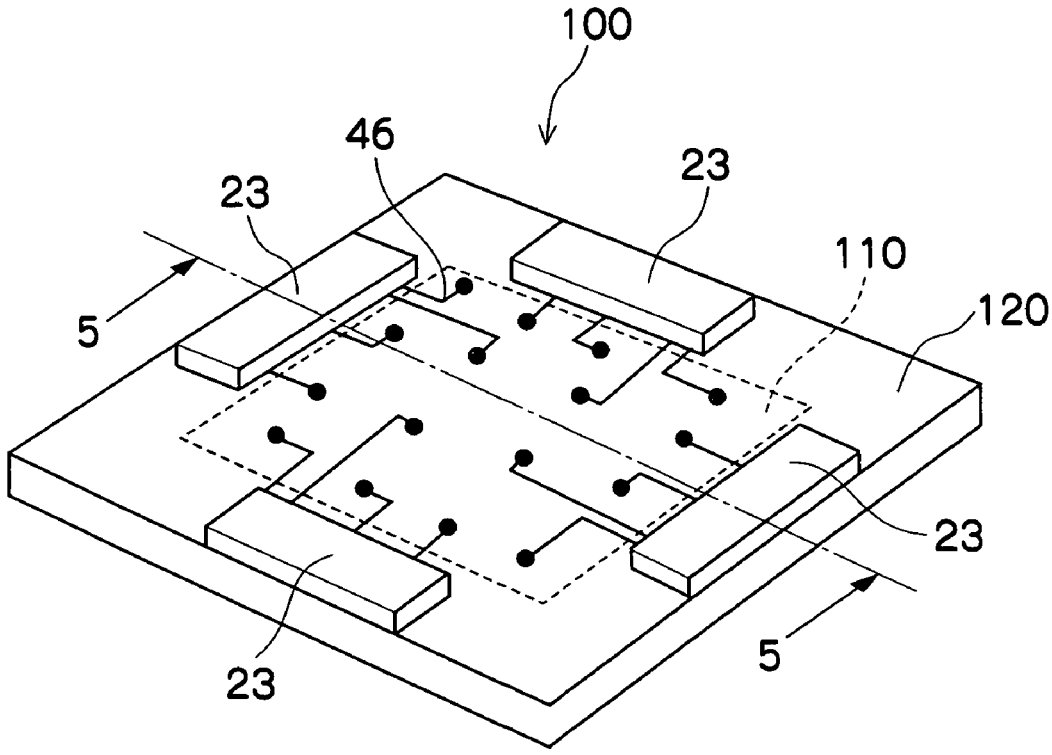
FIG. 6 is an oblique diagram showing the structure of the liquid ejection head according to a third embodiment of the present invention.

Consequently, as shown in FIG. 6, it is possible to form an electrical wiring pattern readily by disposing the switching ICs 23 in the peripheral region of the structural body 120 of the head 100 (in other words, the region apart from the nozzle and pressure chamber region 110).

Figure 7A:
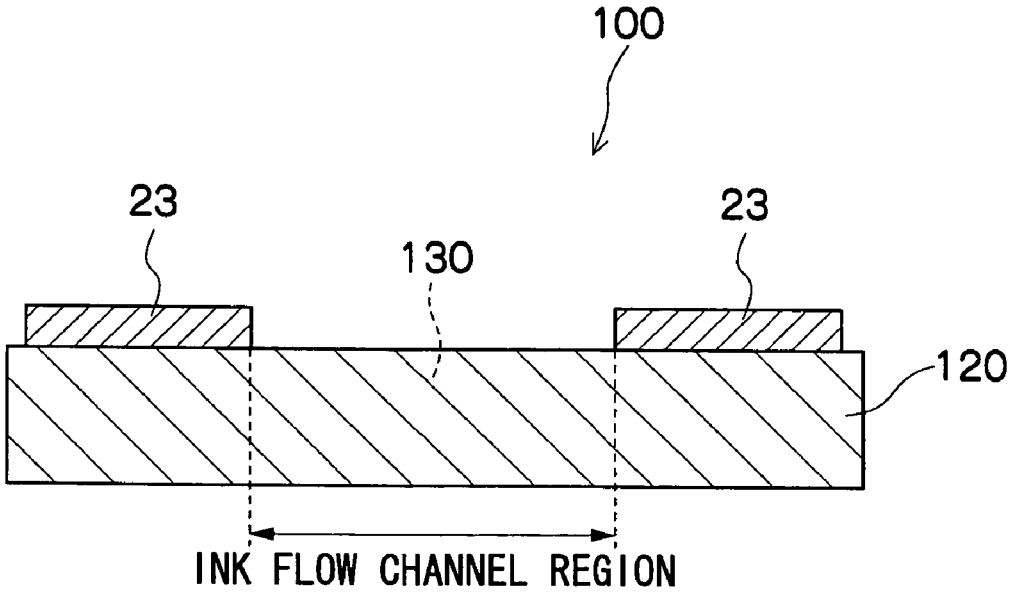
FIGS. 7A and 7B are diagrams for describing the ink flow channel region shown in FIG. 6.

Furthermore, as shown in FIG. 7A, it is even more preferable if a composition is adopted in which the switching ICs 23 are not installed in the ink flow channel region 130, which is the region obtained by projecting the region where the ink flow channels are formed in the head 100 onto the surface 44A of the heat radiating member 44, since this makes it possible to suppress temperature increase inside the ink flow channels due to the heat generated by the switching ICs 23. In general, the surface area of the ink flow channel region 130 shown in FIG. 7A when projected onto the drive circuit installation surface is larger than the surface area of the nozzle and pressure chamber region 110 shown in FIGS. 4 and 6 when projected onto the drive circuit installation surface.

Figure 7B:
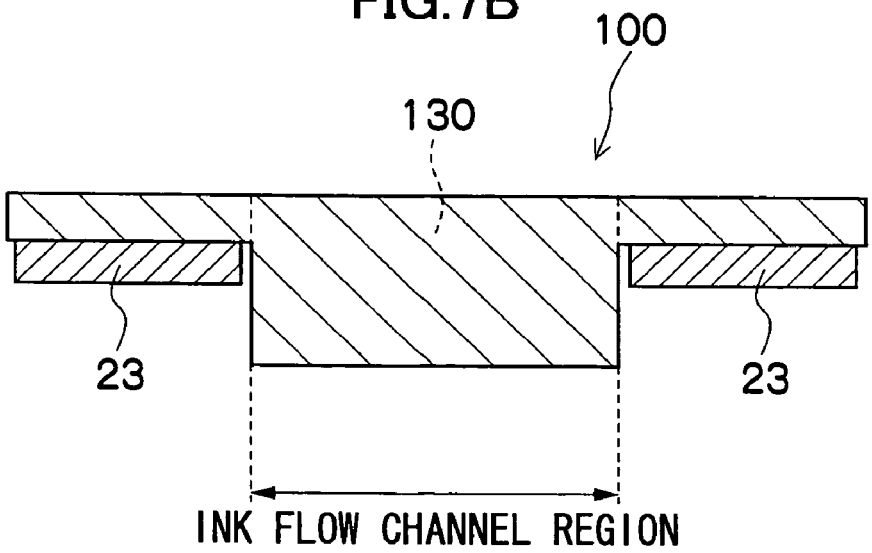

As shown in FIG. 7B, the drive circuit installation surface on which the switching ICs 23 are installed may also be the surface 44B of the heat radiating member 44 on the same side as the heat insulating member.

Figure 8:
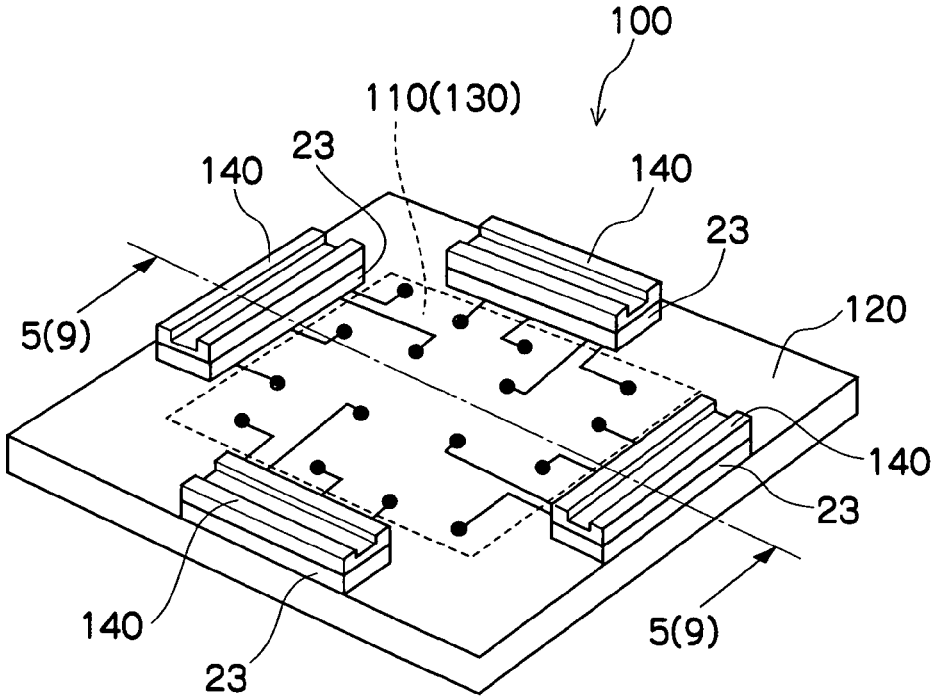
FIG. 8 is an oblique diagram showing one mode of the liquid ejection head shown in FIG. 6.
Figure 9:
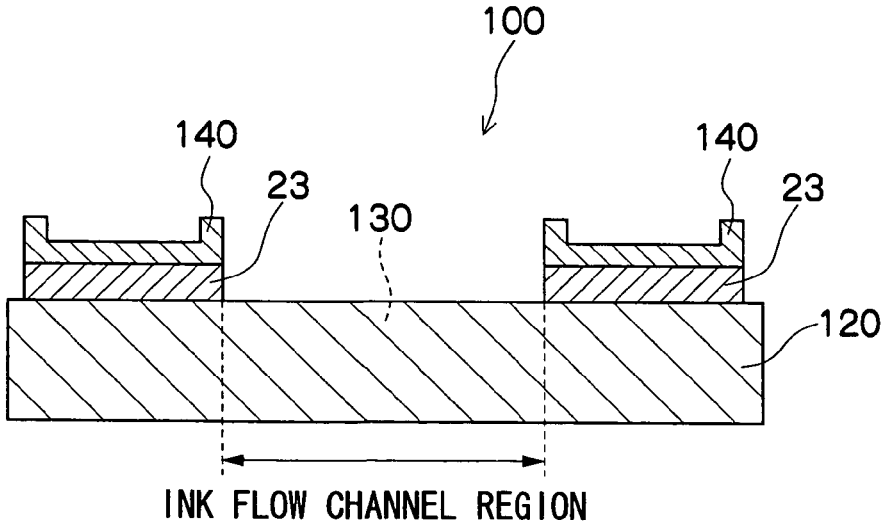
FIG. 9 is a cross-sectional diagram along line 5(9)-5(9) in FIG. 8.

Moreover, as shown in FIGS. 8 and 9, by providing heat radiating plates (drive circuit heat radiating members) 140 on the switching ICs 23, the heat generated by the switching ICs 23 can be removed efficiently to the exterior of the head 100, and therefore, an increased effect can be obtained in suppressing temperature rise in the ink inside the ink flow channels due to this heat. FIG. 9 shows a mode where the cross-sectional shape of the heat radiating plate 140 has a recessed shape, but in order to increase the heat radiating effects of the heat radiating plate 140, it is possible to provide projections, recesses, and the like, in the recess section, for example, thereby increasing the surface area of the heat radiating plate 140 and improving the heat radiating effects yet further.

Here, a ceramic or metallic material having high thermal conductivity is used for the heat radiating plate 140. The relationship between the thermal conductivity $\alpha 2$ of the heat radiating plate 140 and the thermal conductivity $\gamma$ of the insulating structural member 40 is $\alpha 2 > \gamma$.

The relationship between the thermal conductivity a2 of the heat radiating plate 140 and the thermal conductivity $\alpha 1$ of the heat radiating member 44 may be any of $\alpha 2 = \alpha 1$, $\alpha 2 > \alpha 1$, and $\alpha 2 < \alpha 1$.

In the head 100 having the foregoing composition, the switching ICs 23 are installed about the periphery of the nozzle and pressure chamber region 110, which is the region of the two-dimensionally arranged nozzles 12 when projected to the surface 44A of the heat radiating member 44 (in other words, the perimeter region of the head structure 120), and therefore, it is possible to install the switching ICs 23 readily, without having to arrange the electrical wiring pattern at a high density. It is preferable that the switching ICs 23 are disposed in areas which avoid the ink flow channel region 130 corresponding to the region where the ink flow channels are formed, and even more preferably, the heat radiating plates 140 is arranged on the switching ICs 23.

Third Embodiment

Next, a liquid ejection head according to a third embodiment of the present invention is described. In the third embodiment, items which are the same as or similar to those in the first or second embodiment are denoted with the same reference numerals and description thereof is omitted here.

Figure 10:
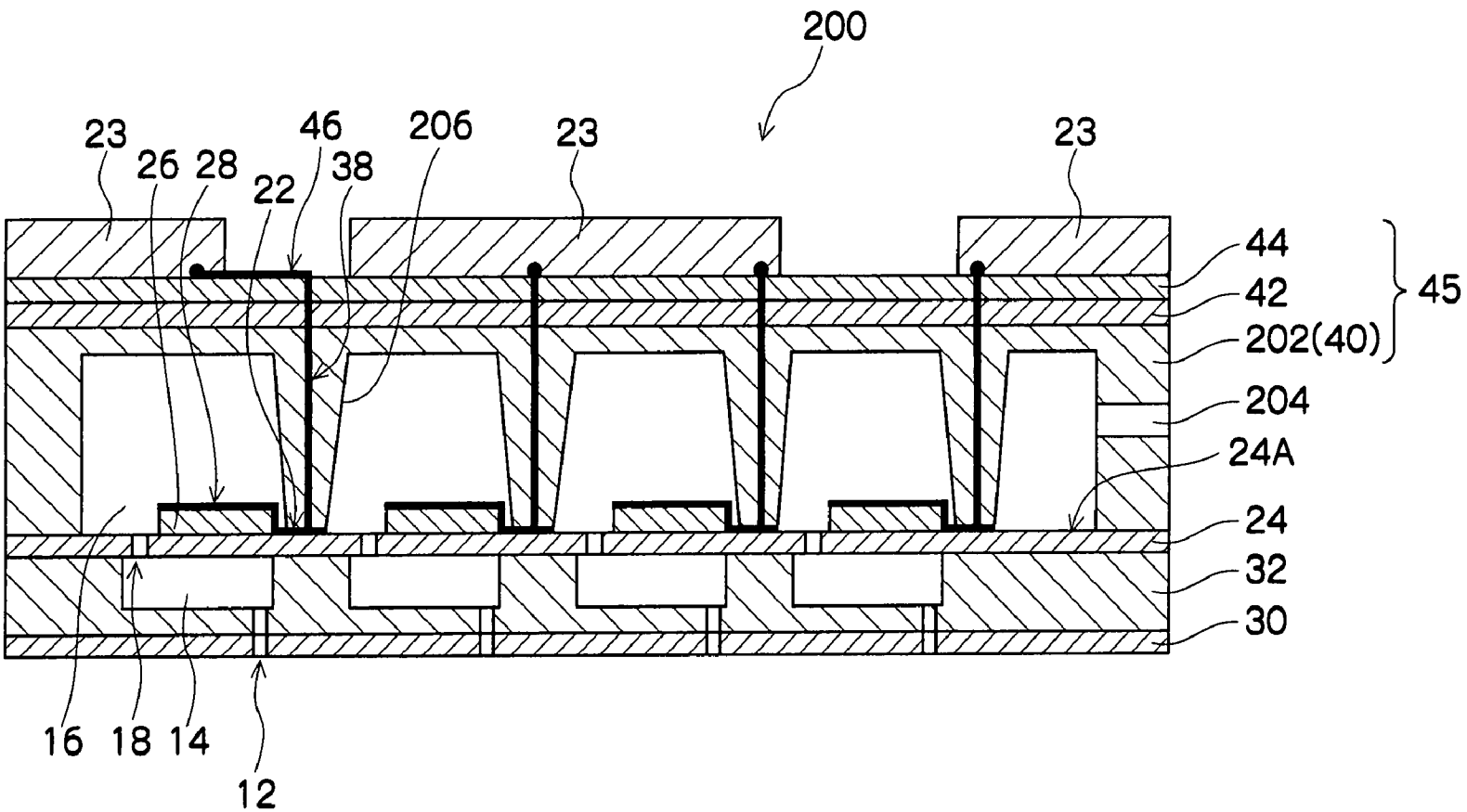
FIG. 10 is a cross-sectional diagram showing the structure of the liquid ejection head according to a third embodiment of the present invention.

FIG. 10 is a cross-sectional diagram showing the three-dimensional structure of a print head 200 according to a third embodiment. Similarly to the heads 10 and 100 shown in the first and second embodiments, the head 200 shown in FIG. 10 has a laminated structure in which a plurality of cavity plates are arranged to overlap each other, namely, a common liquid chamber plate 202 formed with a common liquid chamber 16 and a refill port 204, and the like, for refilling ink to the common liquid chamber 16 from the ink supply system (not shown), is arranged on a pressurization plate 24, on the opposite side thereof from the pressure chambers 14, and the heat insulating member 42 and the heat radiating member 44 are arranged on the common liquid chamber plate 202.

In other words, the common liquid chamber plate 202 functions as the insulating structural member 40 shown in the first and second embodiments.

More specifically, in the head 200, the piezoelectric elements 26 are arranged on the pressurization plate 24 forming the ceiling of the pressure chambers 14 having the nozzles 12 and the supply restrictors 18, the piezoelectric elements 26 are located on the surface (piezoelectric element installation surface 24A) of the pressurization plate 24 reverse to the surface thereof adjacent to the pressure chambers 14, the insulating structural member 40 is arranged on the pads 22 so as to pass through the common liquid chamber 16, and the insulating structural member 40 contains the vertical conducting members 38, which are electrically connected to the pads 22 extending onto the piezoelectric element installation surface 24A from the individual electrodes 28 of the piezoelectric elements 26.

The end sections of the vertical conducting members 38 opposite to the ends bonded to the pads 22 are connected to the horizontal conducting members 46 formed in the heat insulating member 42 or the heat radiating member 44, or to the switching ICs 23 installed on the surface 44A of the heat radiating member 44 reverse to the surface thereof adjacent to the heat insulating member 42.

In the head 200 shown in FIG. 10, the vertical conducting members 38 formed so as to pass through the common liquid chamber 16 are constructed in such a manner that they are covered with the insulating structural member 40, and hence the vertical conducting members 38 are protected from the ink contained in the common liquid chamber 16, as well as ensuring electrical insulation of the vertical conducting members 38 from the ink.

In other words, the vertical conducting members 38 and the insulating structural member 40 which rise up perpendicularly in the form of columns from the pads 22 extending from the individual electrodes 28 on the pressure chambers 14, support, from below, the electrical wiring structure 45 comprising the heat insulating member 42 and the heat radiating member 44, in which the vertical conducting members 38 and the horizontal conducting members 46 for transmitting drive signals to the piezoelectric elements 26 are formed, and a space which forms the common liquid chamber 16 is thereby created. Due to their shape, the vertical conducting members 38 and the portions of the insulating structural member 40 which rise up in this fashion may also be called "electrical columns" below.

FIG. 10 shows a mode where the electrical columns have a tapered shape, whereby the width at one end (the upper end in FIG. 10) is larger than the width at the other end (the lower end in FIG. 10). However, the shape of the electrical columns is not limited to this, and it is also possible for the electrical columns to have substantially the same width through their whole length, or for the width in the approximate center thereof to be larger (or smaller) than the width at either end.

The common liquid chamber 16 is a single large space formed throughout the region where the pressure chambers 14 are disposed, and the common liquid chamber 16 has a planar shape which corresponds to the pressure chamber installation surface. Ink is supplied to the pressure chambers 14 from this plane-shaped common liquid chamber 16 through the supply ports 18 provided in the pressurization plate 24 for the pressure chambers 14.

The present embodiment describes a mode in which one common liquid chamber 16 is provided in order to supply ink to all of the pressure chambers 14, but it is also possible to divide the common liquid chamber 16 into two or more regions.

When composing the head 200 as shown in FIG. 10, it is possible to distribute the arrangement of the vertical conducting members 38, as well as distributing the horizontal conducting members 46 in the plurality of layers, and consequently, there is little restriction on the installation positions of the switching ICs 23 and the installation of the electrical wiring patterns to the switching ICs 23, irrespective of the arrangement of the nozzles 12 and the pressure chambers 14.

Furthermore, by adopting a composition in which the common liquid chamber 16 is connected directly in a vertical direction to the upper side of each pressure chamber 14 through a short ink flow channel (in the present embodiment, through the supply port 18 having a flow channel length corresponding to the thickness of the pressurization plate 24), it is possible to reduce the flow resistance of the supply side flow channel, which supplies ink to the pressure chambers 14, and therefore, high-speed refilling suitable for ejecting ink at a high ejection frequency can be achieved. Consequently, in the case of ink having a higher viscosity than that of normal ink, it is possible to achieve stable ejection, and to ensure the prescribed ejection frequency.

FIGS. 11A to 11F show steps of manufacturing the head 200 in which the common liquid chamber plate 202 (insulating structural member 40) is formed by integrated molding of resin.

Figure 11A:
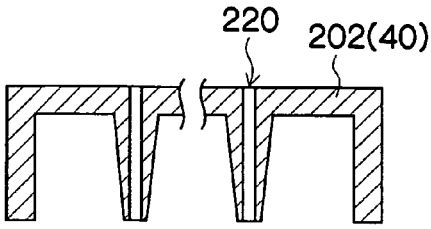
FIGS. 11A to 11F are diagrams showing steps for manufacturing the liquid ejection head shown in FIG. 10.

Firstly, as shown in FIG. 11A, the insulating structural member 40, which supports the common liquid chamber 16, is formed integrally by resin molding. In this case, through holes 220 are formed in the sections where the vertical conducting members 38 are to be formed. For forming the through holes 220, it is possible that, during the resin molding step, pins are arranged in the sections where the through holes 220 are to be formed, and these pins are removed after molding, or alternatively, it is also possible that the through holes 220 are formed by laser processing, or the like, after molding.

Figure 11B:
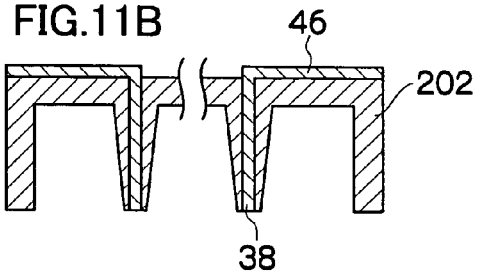

Thereupon, as shown in FIG. 11B, the vertical conducting members 38 are formed inside the through holes 220 by plating or deposition of conductive paste, and the patterned horizontal conducting members 46 are formed on the upper surface of the insulating structural member 40, on the opposite side to the common liquid chamber 16.

Figure 11C:
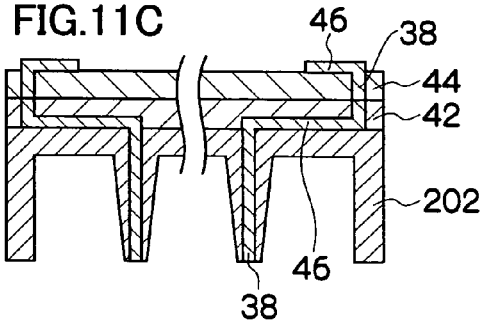

After the vertical conducting members 38 and the horizontal conducting members 46 are formed on the insulating structural member 40 in this way, as shown in FIG. 11C, the heat insulating member 42 and the heat radiating member 44 having been formed with the vertical conducting members 38 and the horizontal conducting members 46 are arranged onto the upper surface of the insulating structural member 40.

Simultaneously with this, the vertical conducting members 38 and the horizontal conducting members 46 are electrically connected to each other by means of conductive adhesive or solder.

Figure 11D:
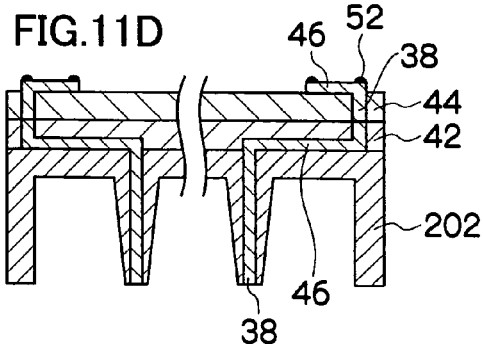
Figure 11E:
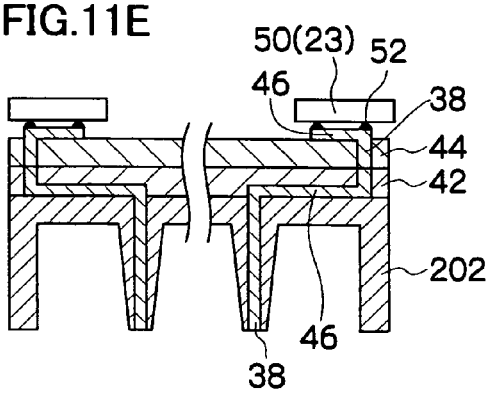

Thereupon, as shown in FIG. 11D, an installation pattern and bumps 52 for the bare chips 50 (the switching ICs 23, see FIG. 11E) are formed, and the bare chips 50 are then installed in prescribed installation positions, as shown in FIG. 11E.

Figure 11F:
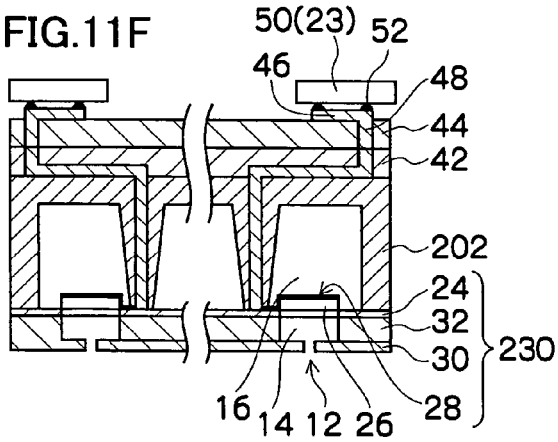

As shown in FIG. 11F, the pads 22 formed on the piezoelectric element installation surface 24A of the flow channel structure 230, formed with the nozzles 12, the pressure chambers 14, the pressurization plate 24, and the piezoelectric elements 26, are bonded with the vertical conducting members 38 of the aforementioned structure which correspond respectively with the pads 22, and prescribed insulating treatment is carried out, thereby completing the head 200.

The present embodiment is a mode where each vertical conducting member 38 is provided for each piezoelectric element 26, but it is also possible to provide a common vertical conducting member 38 for a plurality of piezoelectric elements 26. Furthermore, the vertical conducting members 38 may also transmit signals obtained from sensors provided in the pressure chambers 14, in addition to the drive signals for the piezoelectric elements 26.

Fourth Embodiment

Next, a liquid ejection head according to a fourth embodiment of the present invention will be described.

Figure 12:
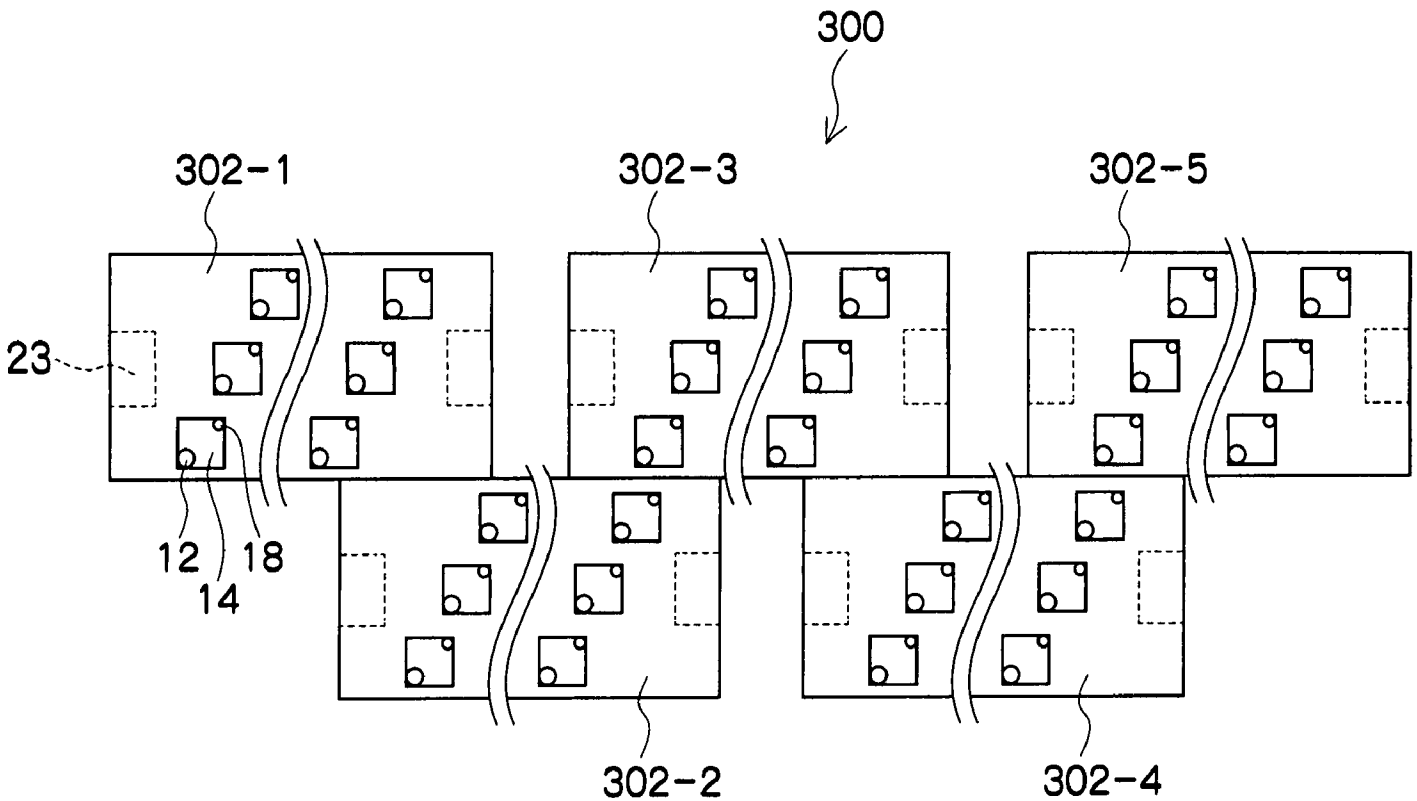
FIG. 12 is a plan diagram the structure of the head according to a fourth embodiment of the present invention.

FIG. 12 shows a head 300 according to the fourth embodiment of the invention. The head 300 is composed by a staggered arrangement of a plurality of head modules having the same composition as the heads 10, 100 and 200 described in the first to third embodiments above, thereby achieving a full line head having a length corresponding to the full width of the printable region (possible recording width) of the media).

The head 300 shown in FIG. 12 has a structure in which five head modules 302 (302-1 to 302-5), each having the same composition and having a length shorter than the possible recording width of the media, are arranged in a staggered matrix configuration.

Switching ICs 23 corresponding to the number of piezoelectric elements 26 (the nozzles 12) in each module are mounted on the respective head modules 302. In the present embodiment, a plurality of switching ICs 23, each capable of driving 512 (or 256) piezoelectric elements 26, are provided, corresponding to the piezoelectric elements 26 on each head module 302.

In other words, the size of the head module 302 (number of nozzles) is determined in such a manner that each head module 302 has a number of nozzles 12 which is compatible with a number of the switching ICs 23 that can be mounted on the module.

As shown in FIG. 12, by composing the full line head 300 by means of the plurality of head modules 302, it is possible to increase the region in which the switching ICs 23 can be mounted, and furthermore, maintenance operations, such as purging and suctioning, can be carried out separately in each of the head modules. Furthermore, since individual head module units can be replaced in the event of a breakdown, then improved maintenance characteristics can be expected.

The switching ICs 23 may be installed on the surface 44A of the heat radiating member 44 reverse to the surface adjacent to the heat insulating member 42 (namely, the upper surface of the head module 302), or the switching ICs 23 may be installed on the surface 44B of the heat radiating member 44 adjacent to the heat insulating member 42 (the rear face).

General Composition of Inkjet Recording Apparatus

Next, an inkjet recording apparatus which employs the liquid ejection head 10 (100, 200 or 300) according to the first to fourth embodiments described above will now be explained.

Figure 13:
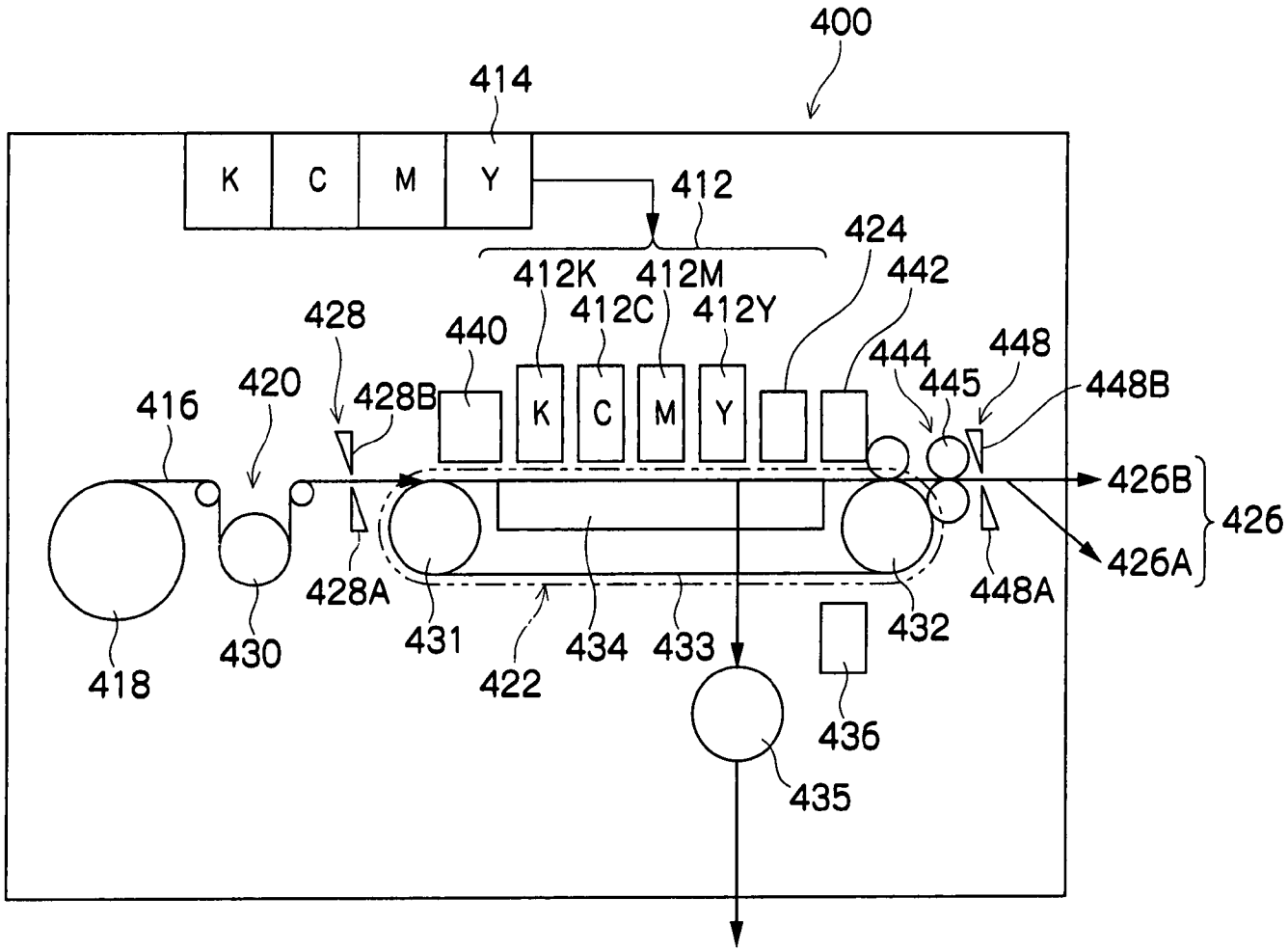
FIG. 13 is a general schematic drawing of an inkjet recording apparatus installed with a liquid ejection head according to an embodiment of the present invention.

FIG. 13 is a general schematic drawing of an inkjet recording apparatus equipped with a liquid ejection head (inkjet head) according to the embodiment of the present invention. As shown in FIG. 13, the inkjet recording apparatus 400 comprises: a printing unit 402 having a plurality of print heads 412K, 412C, 412M, and 412Y provided for ink colors of black (K), cyan (C), magenta (M), and yellow (Y), respectively; an ink storing and loading unit 414 for storing inks to be supplied to the print heads 412K, 412C, 412M, and 412Y; a paper supply unit 418 for supplying recording paper 416 forming a recording medium; a decurling unit 420 removing curl in the recording paper 416; a suction belt conveyance unit 422 disposed facing the ink ejection face of the print unit 412, for conveying the recording paper 416 while keeping the recording paper 416 flat; a print determination unit 424 for reading the printed result produced by the printing unit 412; and a paper output unit 426 for outputting image-printed recording paper 416 (printed matter) to the exterior.

The ink storing and loading unit 414 has ink tanks for storing the inks of K, C, M and Y to be supplied to the heads 412K, 412C, 412M, and 412Y, and the tanks are connected to the heads 412K, 412C, 412M, and 412Y by means of prescribed channels. The ink storing and loading unit 414 has a warning device (for example, a display device or an alarm sound generator) for warning when the remaining amount of any ink is low, and has a mechanism for preventing loading errors among the colors.

In FIG. 13, a magazine for rolled paper (continuous paper) is shown as an embodiment of the paper supply unit 418; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 428 is provided as shown in FIG. 13, and the roll paper is cut to a desired size by the cutter 428. The cutter 428 has a stationary blade 428A, whose length is not less than the width of the conveyor pathway of the recording paper 416, and a round blade 428B, which moves along the stationary blade 428A. The stationary blade 428A is disposed on the reverse side of the printed surface of the recording paper 416, and the round blade 428B is disposed on the side adjacent to the printed surface across the conveyance path. When cut paper is used, the cutter 428 is not required.

In the case of a configuration in which a plurality of types of recording paper can be used, it is preferable that an information recording medium such as a bar code and a wireless tag containing information about the type of paper is attached to the cassette, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 416 delivered from the paper supply unit 418 retains curl due to having been loaded in the magazine. In order to remove the curl, heat is applied to the recording paper 416 in the decurling unit 420 by a heating drum 430 in the direction opposite from the curl direction in the magazine. The heating temperature at this time is preferably controlled so that the recording paper 416 has a curl in which the surface on which the print is to be made is slightly round outward.

The decurled and cut recording paper 416 is delivered to the suction belt conveyance unit 422. The suction belt conveyance unit 422 has a configuration in which an endless belt 433 is set around rollers 431 and 432 so that the portion of the endless belt 433 facing at least the nozzle face of the printing unit 412 forms a horizontal plane (flat plane).

The belt 433 has a width that is greater than the width of the recording paper 416, and a plurality of suction apertures (not shown) are formed on the belt surface. A suction chamber 434 is disposed in a position facing the nozzle surface of the printing unit 412 on the interior side of the belt 433, which is set around the rollers 431 and 432, as shown in FIG. 13. The suction chamber 434 provides suction with a fan 435 to generate a negative pressure, and the recording paper 416 is held on the belt 433 by suction.

The belt 433 is driven in the clockwise direction in FIG. 13 by the motive force of a motor (not shown in FIG. 13 but indicated by reference numeral 488 in FIG. 15) being transmitted to at least one of the rollers 431 and 432, which the belt 433 is set around, and the recording paper 416 held on the belt 433 is conveyed from left to right in FIG. 13.

Since ink adheres to the belt 433 when a marginless print job or the like is performed, a belt-cleaning unit 436 is disposed in a predetermined position (a suitable position outside the printing area) on the exterior side of the belt 433. Although the details of the configuration of the belt-cleaning unit 436 are not shown, embodiments thereof include a configuration in which the belt 433 is nipped with cleaning rollers such as a brush roller and a water absorbent roller, an air blow configuration in which clean air is blown onto the belt 433, or a combination of these. In the case of the configuration in which the belt 433 is nipped with the cleaning rollers, it is preferable to make the line velocity of the cleaning rollers different than that of the belt 433 to improve the cleaning effect.

The inkjet recording apparatus 400 can comprise a roller nip conveyance mechanism, in which the recording paper 416 is pinched and conveyed with nip rollers, instead of the suction belt conveyance unit 422. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 440 is disposed on the upstream side of the printing unit 412 in the conveyance pathway formed by the suction belt conveyance unit 422. The heating fan 440 blows heated air onto the recording paper 416 to heat the recording paper 416 immediately before printing so that the ink deposited on the recording paper 416 dries more easily.

Figure 14:
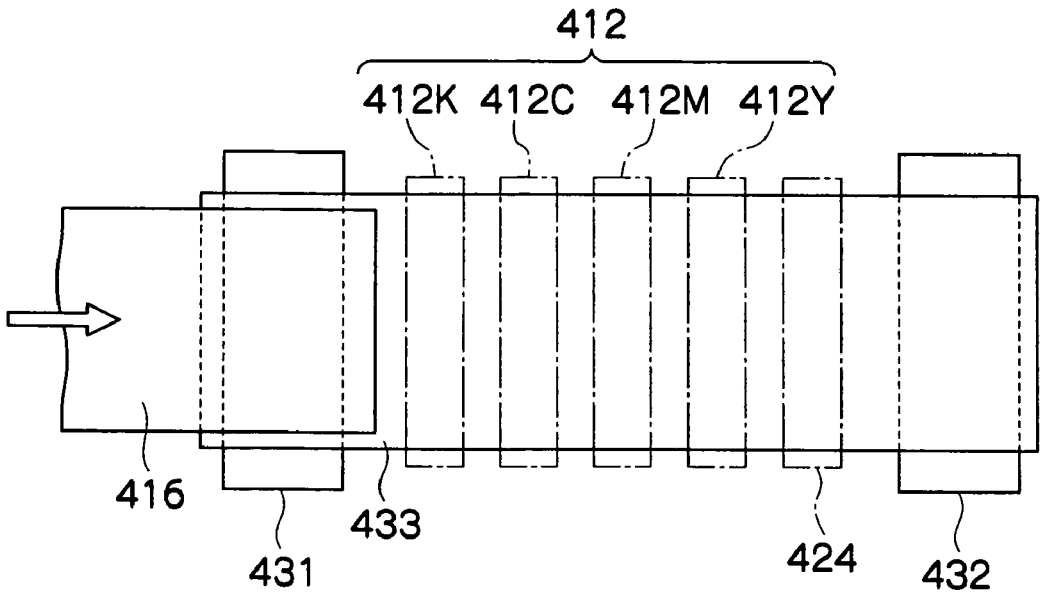
FIG. 14 is a principal plan diagram of the peripheral area of a print unit in the inkjet recording apparatus shown in FIG. 13.

The print heads 412K, 412C, 412M and 412Y of the printing unit 412 are full line print heads having a length corresponding to the maximum width (required printing width) of the recording medium 416 used with the inkjet recording apparatus 400, and comprising a plurality of nozzles for ejecting ink arranged on a nozzle surface through a length exceeding at least one edge of the maximum-size recording medium (namely, the full width of the printable range) (see FIG. 14).

The print heads 412K, 412C, 412M and 412Y are arranged in color order (black (K), cyan (C), magenta (M), yellow (Y)) from the upstream side in the feed direction of the recording paper 416, and these respective heads 412K, 412C, 412M and 412Y are fixed extending in a direction substantially perpendicular to the feed direction (the sub-scanning direction) of the recording paper 416.

A color image can be formed on the recording paper 416 by ejecting inks of different colors from the heads 412K, 412C, 412M and 412Y, respectively, onto the recording paper 416 while the recording paper 416 is conveyed by the suction belt conveyance unit 422.

By adopting a configuration in which the full line print heads 412K, 412C, 412M and 412Y having nozzle rows covering the full paper width are provided for the respective colors in this way, it is possible to record an image on the full surface of the recording paper 416 by performing just one operation of relatively moving the recording paper 416 and the printing unit 412 in the recording paper feed direction, in other words, by means of a single sub-scanning action. Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added. Furthermore, there are no particular restrictions of the sequence in which the heads of respective colors are arranged.

A post-drying unit 442 is disposed following the printing unit 412. The post-drying unit 442 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 444 is disposed following the post-drying unit 442. The heating/pressurizing unit 444 is a device to control the glossiness of the image surface, and the image surface is pressed with a pressure roller 445 having a predetermined uneven surface shape while the image surface is heated, and the uneven shape is transferred to the image surface.

The printed object generated in this manner is output through the paper output unit 426. It is preferable that the actual image that is to be printed (the printed copy of the desired image), and test prints, are output separately. In the inkjet recording apparatus 400, a sorting device (not shown) is provided for switching the outputting pathway in order to sort the printed matter with the target print and the printed matter with the test print, and to send them to paper output units 426A and 426B, respectively. In a composition where rolled paper is used, if the main image and the test print are formed simultaneously in a parallel fashion, on a large piece of printing paper, then the portion corresponding to the test print is cut off by means of a cutter (second cutter) which is not shown in the drawings. The second cutter is disposed immediately in front of the paper output section 426, and it serves to cut and separate the main image from the test print section, in cases where a test image is printed onto the white margin of the image. The structure of the second cutter is similar to that of the first cutter described above, and it is constituted by a stationary blade and a round blade.

Although not shown in FIG. 13, the paper output unit 426A for the target prints is provided with a sorter for collecting prints according to print orders.

Description of Control System

Figure 15:
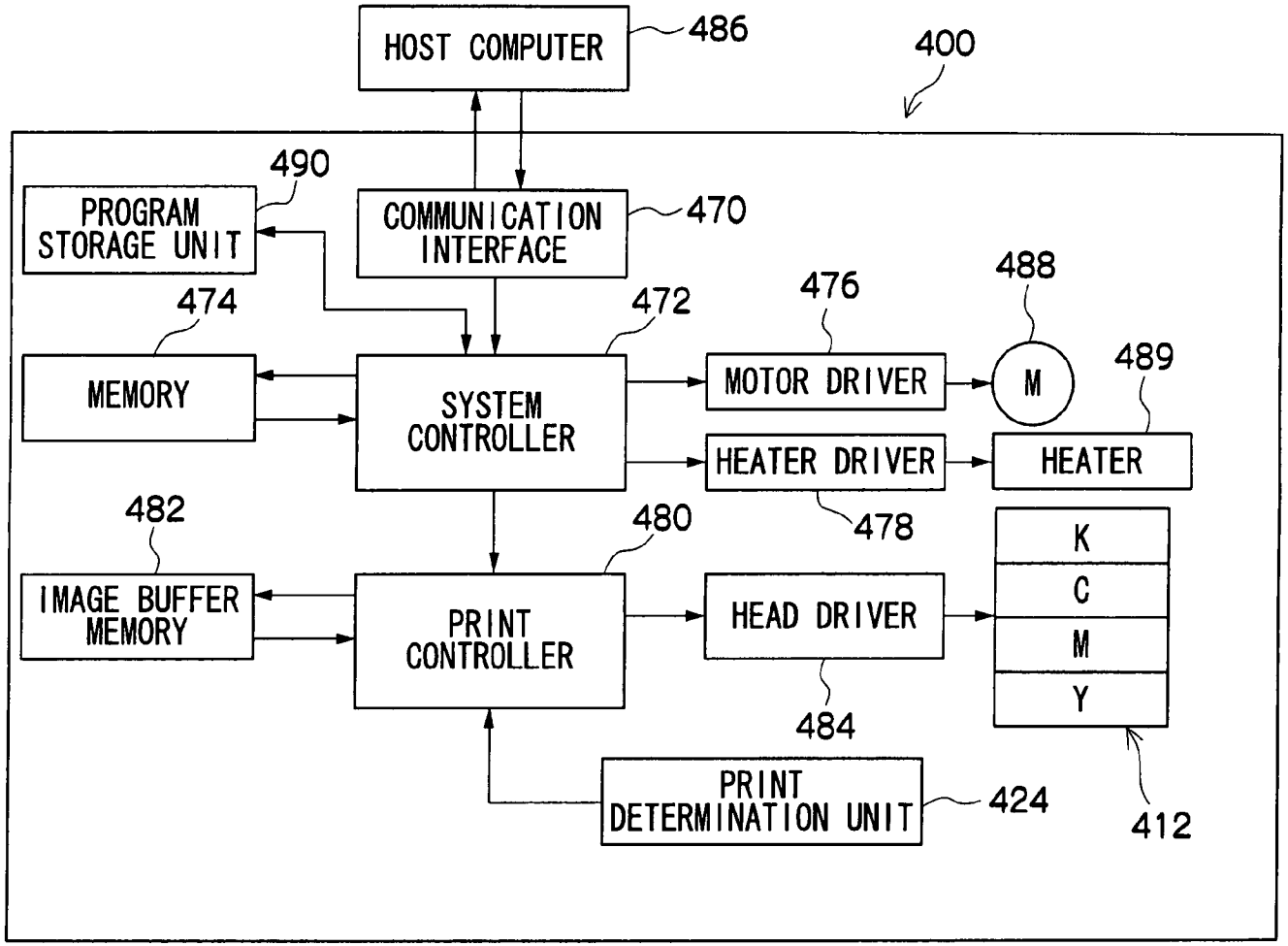
FIG. 15 is a principal block diagram showing the system configuration of the inkjet recording apparatus shown in FIG. 13.

FIG. 15 is a principal block diagram showing the system configuration of the inkjet recording apparatus 400. The inkjet recording apparatus 400 comprises a communication interface 470, a system controller 472, an image memory 474, a motor driver 476, a heater driver 478, a print controller 480, an image buffer memory 482, a head driver 484, and the like.

The communication interface 470 is an interface unit for receiving image data sent from a host computer 486. A serial interface such as USB, IEEE1394, Ethernet, wireless network, or a parallel interface such as a Centronics interface may be used as the communication interface 470. A buffer memory (not shown) may be mounted in this portion in order to increase the communication speed. The image data sent from the host computer 486 is received by the inkjet recording apparatus 400 through the communication interface 470, and is temporarily stored in the image memory 474.

The image memory 474 is a storage device for temporarily storing images inputted through the communication interface 470, and data is written and read to and from the image memory 474 through the system controller 472.

The system controller 472 is constituted by a central processing unit (CPU) and peripheral circuits thereof, and the like, and it functions as a control device for controlling the whole of the inkjet recording apparatus 400 in accordance with a prescribed program, as well as a calculation device for performing various calculations. More specifically, the system controller 472 controls the various sections, such as the communication interface 470, image memory 474, motor driver 476, heater driver 478, and the like, as well as controlling communications with the host computer 486 and writing and reading to and from the image memory 474, and it also generates control signals for controlling the motor 488 and heater 489 of the conveyance system.

The motor driver 476 drives the motor 488 in accordance with commands from the system controller 472. The heater driver (drive circuit) 478 drives the heater 489 of the post-drying unit 442 or the like in accordance with commands from the system controller 472.

The print controller 480 has a signal processing function for performing various tasks, compensations, and other types of processing for generating print control signals from the image data stored in the image memory 474 in accordance with commands from the system controller 472 so as to supply the generated print data to the head driver 484. Prescribed signal processing is carried out in the print controller 480, and the ejection amount and the ejection timing of the ink droplets from the print heads 412K, 412C, 412M and 412Y are controlled through the head driver 484. By this means, prescribed dot size and dot positions can be achieved.

The print controller 480 is provided with the image buffer memory 482; and image data, parameters, and other data are temporarily stored in the image buffer memory 482 when image data is processed in the print controller 480. The aspect shown in FIG. 15 is one in which the image buffer memory 482 accompanies the print controller 480; however, the image memory 474 may also serve as the image buffer memory 482. Also possible is an aspect in which the print controller 480 and the system controller 472 are integrated to form a single processor.

The head driver 484 generates drive signals on the basis of print data supplied by the print controller 480 and drives the piezoelectric elements of the print heads of the respective colors, 412K, 412C, 412M and 412Y, by means of these drive signals. A feedback control system for maintaining constant drive conditions in the head may be included in the head driver 484.

The image data to be printed (the image data obtained by converting the image size and resolution in accordance with the size of the recording paper 416) is input from an external source through the communications interface 470, and is collected in the image memory 474. At this stage, RGB image data is stored in the image memory 474.

The image data stored in the image memory 474 is sent to the print controller 480 through the system controller 472, and is converted to the dot data for each ink color in the print controller 480. In other words, the print controller 480 performs processing for converting the inputted RGB image data into dot data for four colors, K, C, M and Y The dot data generated by the print controller 480 is stored in the image buffer memory 482.

Various control programs are stored in a program storage unit 490, and a control program is read out and executed in accordance with commands from the system controller 472. The program storage unit 490 may use a semiconductor memory, such as a ROM, EEPROM, or a magnetic disk, or the like. An external interface may be provided, and a memory card or PC card may also be used. Naturally, a plurality of these storage media may also be provided.

The program storage unit 490 may also be combined with a storage device (memory) (not shown) for storing operational parameters (system parameters), and the like.

The print determination unit 424 is a block that includes the line sensor as described above with reference to FIG. 13, reads the image printed on the recording paper 416, determines the print conditions (presence of the ejection, variation in the dot formation, and the like) by performing desired signal processing, or the like, and provides the determination results of the print conditions to the print controller 480.

According to requirements, the print controller 480 makes various corrections with respect to the print heads 412K, 412C, 412M and 412Y on the basis of information obtained from the print determination unit 424.

In the embodiment shown in FIG. 13, the print determination unit 424 is provided on the print surface side, the print surface is irradiated with a light source (not shown), such as a cold cathode tube disposed in the vicinity of the line sensor, and the reflected light is read in by the line sensor. However, in implementing the present invention, another composition may be adopted.

The present embodiment described an inkjet recording apparatus 400 which forms images on recording paper 416 by ejecting ink from nozzles provided in a print head, but the scope of application of the present invention is not limited to this, and it may also be applied widely to liquid ejection apparatuses, such as dispensers, which eject liquid, such as treatment liquid, chemical solution, or water, onto a liquid receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of pressure chambers which are provided correspondingly to a plurality of ejection holes formed on a first wall defining the pressure chambers, the ejection holes being two-dimensionally arranged and ejecting liquid toward a liquid receiving medium, the pressure chambers accommodating the liquid to be ejected from the ejection holes;

a common liquid chamber which supplies the liquid to the pressure chambers;

a plurality of piezoelectric elements which are provided correspondingly to the pressure chambers and are arranged on a second wall defining the pressure chambers opposing the first wall, the piezoelectric elements each having individual electrodes to which drive signals are applied;

a plurality of extending electrodes which extend from the individual electrodes of the piezoelectric elements and we electrically connected to the individual electrodes;

a structural member which is bonded to a first surface of the second wall reverse to a second surface thereof adjacent to the pressure chambers, the structural member having a laminated structure in which at least two members we arranged to overlap each other, the at least two members including an outermost member having a surface in contact with atmosphere and serving as a heat radiating member, the at least two members including at least one member serving as a heat insulating member;

a drive circuit which is installed on the outermost member of the structural member, the drive circuit generating the drive signals to be applied to the piezoelectric elements; and a plurality of conducting members which electrically connect the extending electrodes and the drive circuit, the conducting members having vertical conducting portions which are formed in a direction substantially vertical to a plane on which the piezoelectric elements are arranged, and horizontal conducting portions which are formed in a direction substantially perpendicular to the vertical conducting portions, the vertical conducting portions being contained in the structural member and each of the horizontal conducting portions being formed on a surface of at least one of the heat radiating member and the heat insulating member in plan view and intersecting with the vertical conducting portions.

2. The liquid ejection head as defined in claim 1, wherein the at least two members of the structural member include an insulating structural member bonded to the first surface of the second wall.

3. The liquid ejection head as defined in claim 1, wherein the drive circuit is integrated in at least one integrated circuit, the at least one integrated circuit being flip-chip mounted on the heat radiating member.

4. The liquid ejection head as defined in claim 1, wherein thermal conductivity of the heat radiating member is higher than thermal conductivity of the heat insulating member.

5. The liquid ejection head as defined in claim 1, wherein the heat insulating member includes one of thermosetting epoxy resin and thermosetting epoxy resin containing microparticles of inorganic material.

6. The liquid ejection head as defined in claim 1, wherein the drive circuit is provided with a drive circuit heat radiating member.

7. The liquid ejection head as defined in claim 6, wherein thermal conductivity of the drive circuit heat radiating member is higher than thermal conductivity of the heat insulating member.

8. The liquid ejection head as defined in claim 1, wherein:

the common liquid chamber is arranged on a side of the first surface of the second wall; and the conducting members are arranged so as to rise from the surface of the second wall on which the piezoelectric elements are arranged and pass through the common liquid chamber.

9. The liquid ejection head as defined in claim 1, wherein the drive circuit is arranged in a region on the heat radiating member corresponding to a region where the pressure chambers are not arranged.

10. The liquid ejection head as defined in claim 1, wherein the drive circuit is arranged in a region on the heat radiating member corresponding to a region where the common liquid chamber is not arranged.

11. The liquid ejection head as defined in claim 1, wherein the ejection holes are arranged through a length corresponding to a full width of a liquid receiving region of the liquid receiving medium.

12. The liquid ejection head as defined in claim 11, comprising a plurality of liquid ejection head modules which are arranged in a width direction of the liquid receiving medium, each of the liquid ejection head modules having an ejection hole row in which the ejection holes are arranged through a length shorter than the full width of the liquid receiving region of the liquid receiving medium.

13. The liquid ejection head as defined in claim 1, wherein the driving circuit is not installed in an ink flow channel region.

14. The liquid ejection head as defined in claim 1, wherein the plurality of conducting members are formed using the horizontal conducting portions and the vertical conducting portions to reduce the size of the liquid ejection head.

15. The liquid ejection head as defined in claim 1, wherein the horizontal conductive portions are formed at least on the heat insulating member.

16. The liquid ejection head as defined in claim 1, wherein the vertical conducting portions pass through the heat radiating member and are connected directly to projecting electrodes of the drive circuit integrated in an integrated circuit.

17. A liquid ejection head comprising:

a plurality of pressure chambers which are provided correspondingly to a plurality of ejection holes formed on a first wall defining the pressure chambers, the ejection holes being two-dimensionally arranged and ejecting liquid toward a liquid receiving medium, the pressure chambers accommodating the liquid to be ejected from the ejection holes;

a common liquid chamber which supplies the liquid to the pressure chambers;

a plurality of piezoelectric elements which are provided correspondingly to the pressure chambers and are arranged on a second wall defining the pressure chambers opposing the first wall, the piezoelectric elements each having individual electrodes to which drive signals are applied;

a plurality of extending electrodes which extend from the individual electrodes of the piezoelectric elements and are electrically connected to the individual electrodes;

a structural member which is bonded to a first surface of the second wall reverse to a second surface thereof adjacent to the pressure chambers, the structural member having a laminated structure in which at least two members are arranged to overlap each other, the at least two members including an outermost member having a surface in contact with atmosphere and serving as a heat radiating member the at least two members including at least one member serving as a heat insulating member;

a drive circuit which is installed on the outermost member of the structural member, the drive circuit generating the drive signals to be applied to the piezoelectric elements: and a plurality of conducting members which electrically connect the extending electrodes and the drive circuit, the conducting members having vertical conducting portions which are formed in a direction substantially vertical to a plane on which the piezoelectric elements are arranged, and horizontal conducting portions which are formed in a direction substantially perpendicular to the vertical conducting portions, the vertical conducting portions being contained in the structural member and each of the horizontal conducting portions being formed on a surface of at least one of the heat radiating member and the heat insulating member in plan view and intersecting with the vertical conducting portions, wherein:

the common liquid chamber is arranged over the plurality of piezoelectric elements; and the structural member including the heat radiating member and the heat insulating member is arranged over the common liquid chamber.

* * * * *